US012280855B2

(12) United States Patent
Cottrell

(10) Patent No.: US 12,280,855 B2
(45) Date of Patent: Apr. 22, 2025

(54) SOFT YOKE MOORING ARRANGEMENT

(71) Applicant: Cottrell & Cottrell, LLC, Houston, TX (US)

(72) Inventor: Roy Cottrell, Houston, TX (US)

(73) Assignee: COTTRELL & COTTRELL, LLC, Houston, TX (US)

( * ) Notice: Subject to any disclaimer, the term of this patent is extended or adjusted under 35 U.S.C. 154(b) by 511 days.

(21) Appl. No.: 17/751,962

(22) Filed: May 24, 2022

(65) Prior Publication Data

US 2022/0371691 A1 Nov. 24, 2022

Related U.S. Application Data

(60) Provisional application No. 63/192,190, filed on May 24, 2021.

(51) Int. Cl.
*B63B 21/04* (2006.01)
*B63B 21/00* (2006.01)

(52) U.S. Cl.
CPC ..... *B63B 21/04* (2013.01); *B63B 2021/002* (2013.01); *B63B 2021/005* (2013.01)

(58) Field of Classification Search
CPC ..... B63B 21/04; B63B 2021/005
See application file for complete search history.

(56) References Cited

U.S. PATENT DOCUMENTS

| | | | | |
|---|---|---|---|---|
| 6,439,147 | B2 * | 8/2002 | Cottrell | B63B 21/50 114/230.1 |
| 8,100,077 | B2 * | 1/2012 | Collee | F03B 11/00 290/53 |
| 11,305,843 | B2 * | 4/2022 | Hovde | B63B 27/18 |
| 2016/0251061 | A1 * | 9/2016 | Tosetti | B63B 21/50 114/230.1 |
| 2017/0113762 | A1 * | 4/2017 | Lindblade | B63B 21/00 |
| 2023/0150614 | A1 * | 5/2023 | Duggal | B63B 21/26 114/230.1 |
| 2023/0257074 | A1 * | 8/2023 | Yu | B63B 21/16 114/230.1 |
| 2024/0253743 | A1 * | 8/2024 | Ganzinga | B63B 21/50 |

FOREIGN PATENT DOCUMENTS

| | | | | |
|---|---|---|---|---|
| WO | WO-2012123191 | A1 * | 9/2012 | B63B 21/00 |

* cited by examiner

*Primary Examiner* — S. Joseph Morano
*Assistant Examiner* — Jovon E Hayes
(74) *Attorney, Agent, or Firm* — Ewing & Jones, PLLC

(57) ABSTRACT

Aspects of the disclosure pertain to single point mooring systems and method used in relation to single point mooring systems wherein, the system divides the restoring weight for the mooring system in two and removes hinges and swivel joints from the gravitational load path suspending the restoring weight.

13 Claims, 29 Drawing Sheets

Coordinate Convention

Conventional Permanently Moored

Conventional Disconnectably Moored

Conventional Soft Yoke at Rest (Profile)

Conventional Soft Yoke Operating Principal (Profile)

Conventional Soft Yoke at Rest (Plan View)

Conventional Soft Yoke with Yaw Angle (Plan View)

Conventional Permanently Moored Submerged Yoke

Conventional Disconnectably Moored Submerged Yoke

Conventional Disconnectably Moored Submerged Yoke

Conventional Disconnectably Moored Submerged Yoke
Effect of Shifting Weather Direction Conventional Soft Yoke Additional y-axis (Profile)

Conventional Soft Yoke Additional y-axis (Profile)

Conventional Mechanical Mooring Profile

Conventional Mechanical Mooring Plan View

Conventional Mechanical Mooring Profile View

Conventional Mechanical Mooring Plan View

Conventional Mechanical Mooring Plan View with Yaw Angle

Conventional Mechanical Mooring At Rest

Conventional Mechanical Mooring Showing Operating Principal

The Disclosure: Permanent Mooring Configuration

The Disclosure: Permanent Mooring Configuration

The Disclosure: Permanent Mooring Configuration

The Disclosure: Permanent Mooring Configuration

The Disclosure: Permanently Moored Fulcrum Configuration

The Disclosure: Permanently Moored Fulcrum Configuration

The Disclosure: Permanent Fulcrum Mooring Configuration

The Disclosure: Permanent Fulcrum Mooring Configuration

The Disclosure: Permanently Moored Submerged Yoke

The Disclosure: Disconnectably Moored Submerged Yoke

The Disclosure: Disconnectable Submerged Yoke Mooring

The Disclosure:
Permanent Submerged Ballast Weight Fulcrum Mooring

The Disclosure:
Disconnectable Submerged Ballast Weight Fulcrum Mooring

The Disclosure:
Disconnection Means Pin Style

The Disclosure:
Disconnection Means Pin Style

The Disclosure:
Disconnection Means Collet Connector Style

The Disclosure:
Disconnection Means Collet Connector Style

Profile View

The Disclosure:
Disconnection Means Collet Connector Style

Profile View

FIG. 25 The Disclosure: Disconnection - Reconnection
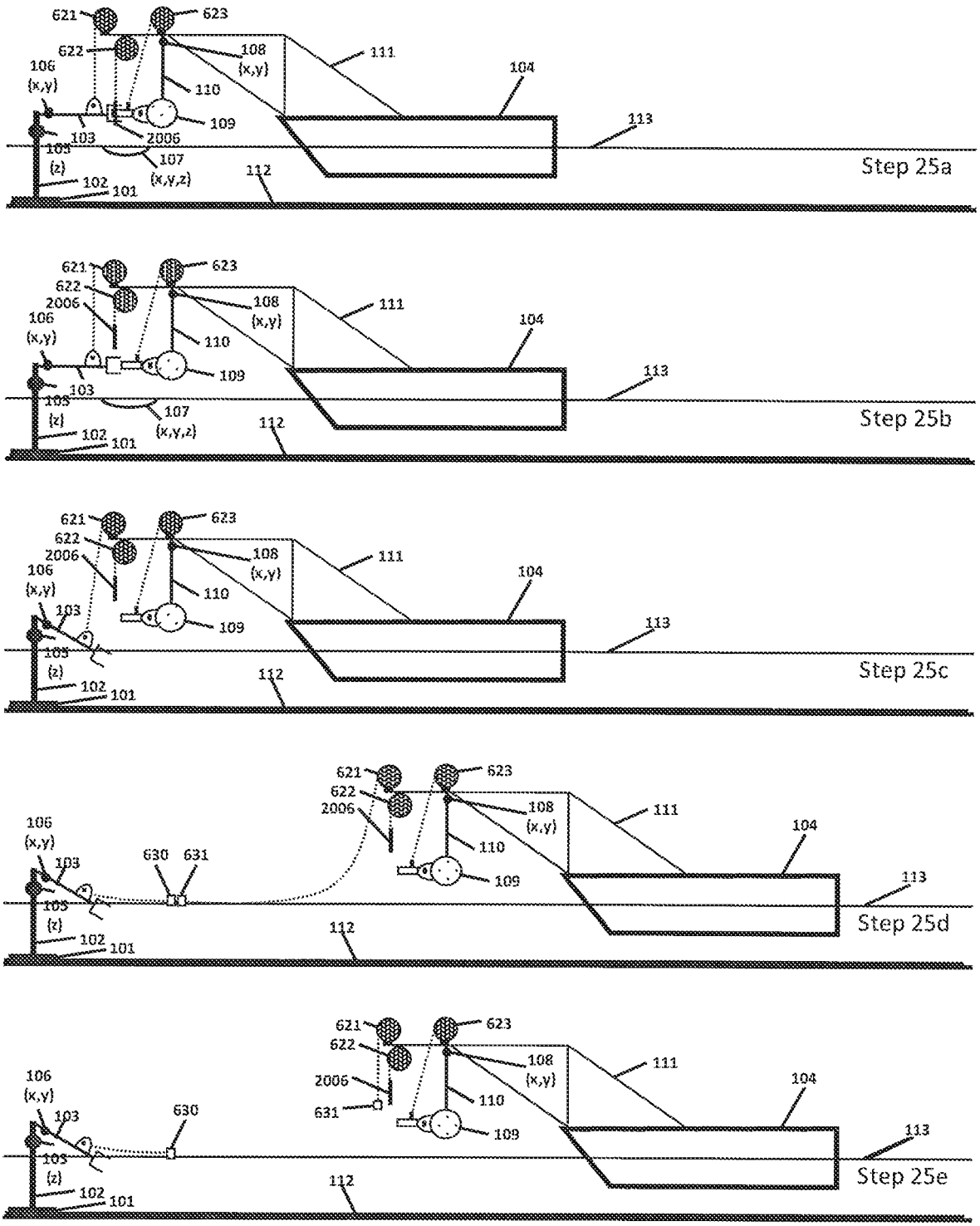

FIG. 26 The Disclosure: Disconnection - Reconnection
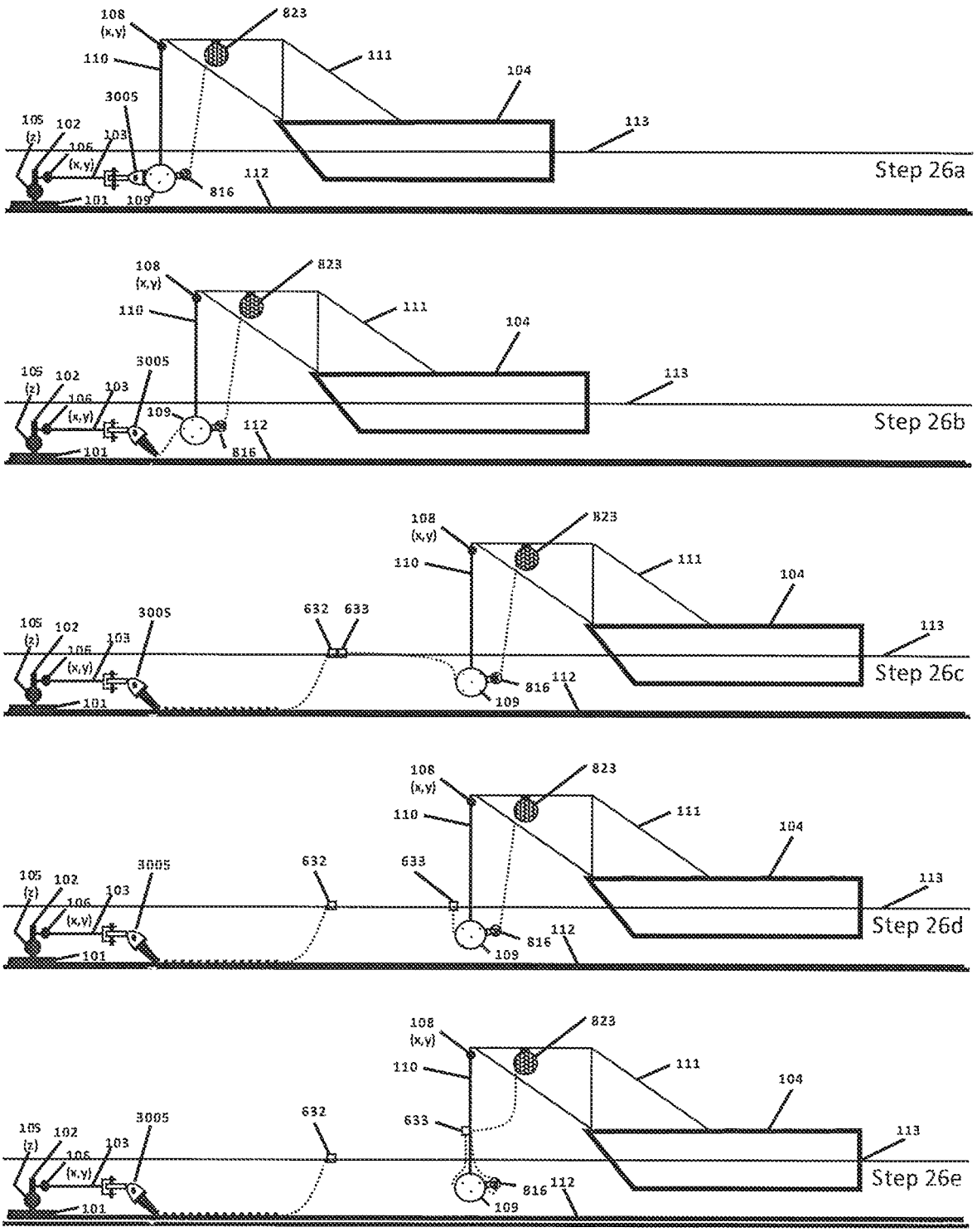

FIG. 27 The Disclosure: Disconnection - Reconnection
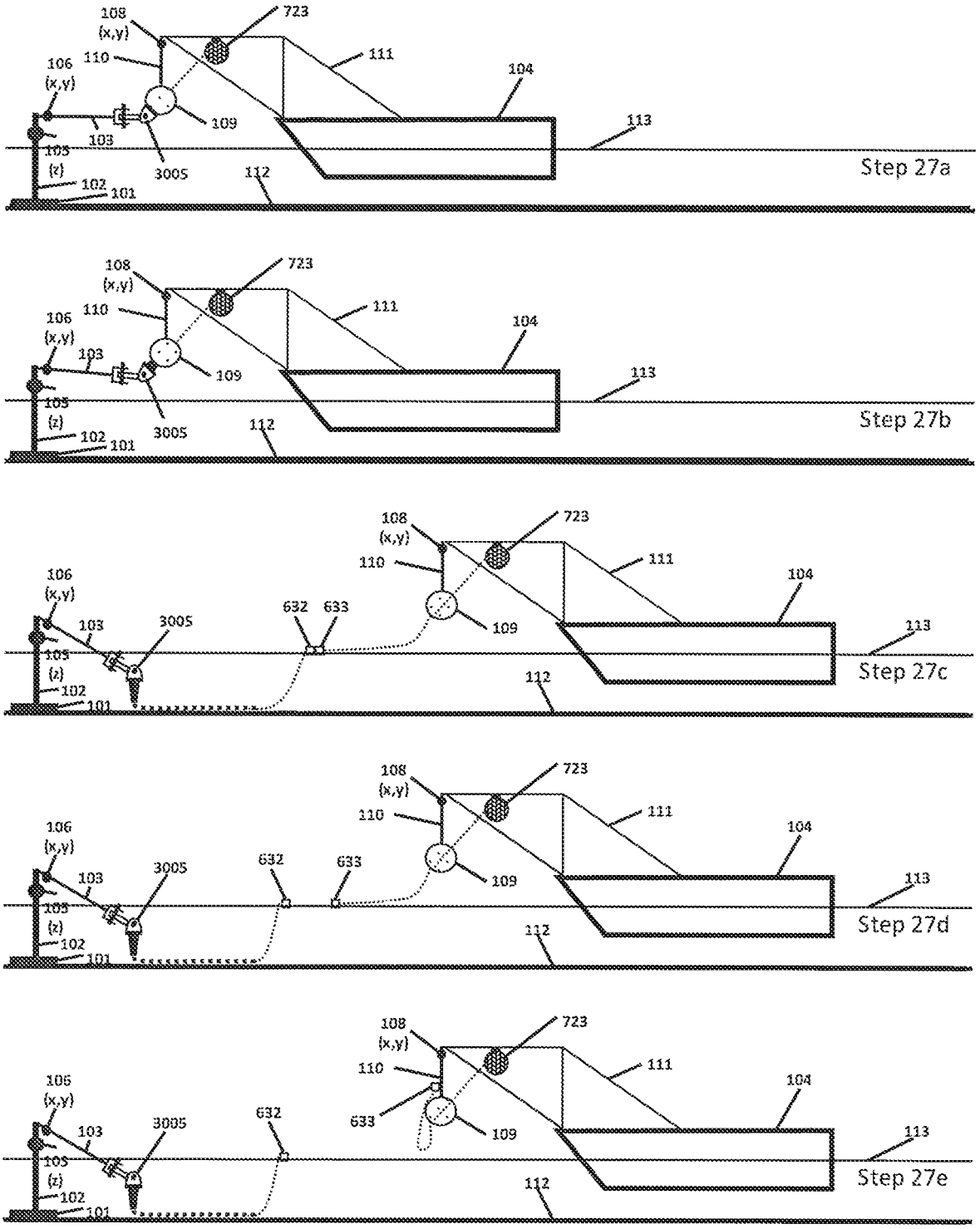

FIG. 28 The Disclosure: Disconnection - Reconnection
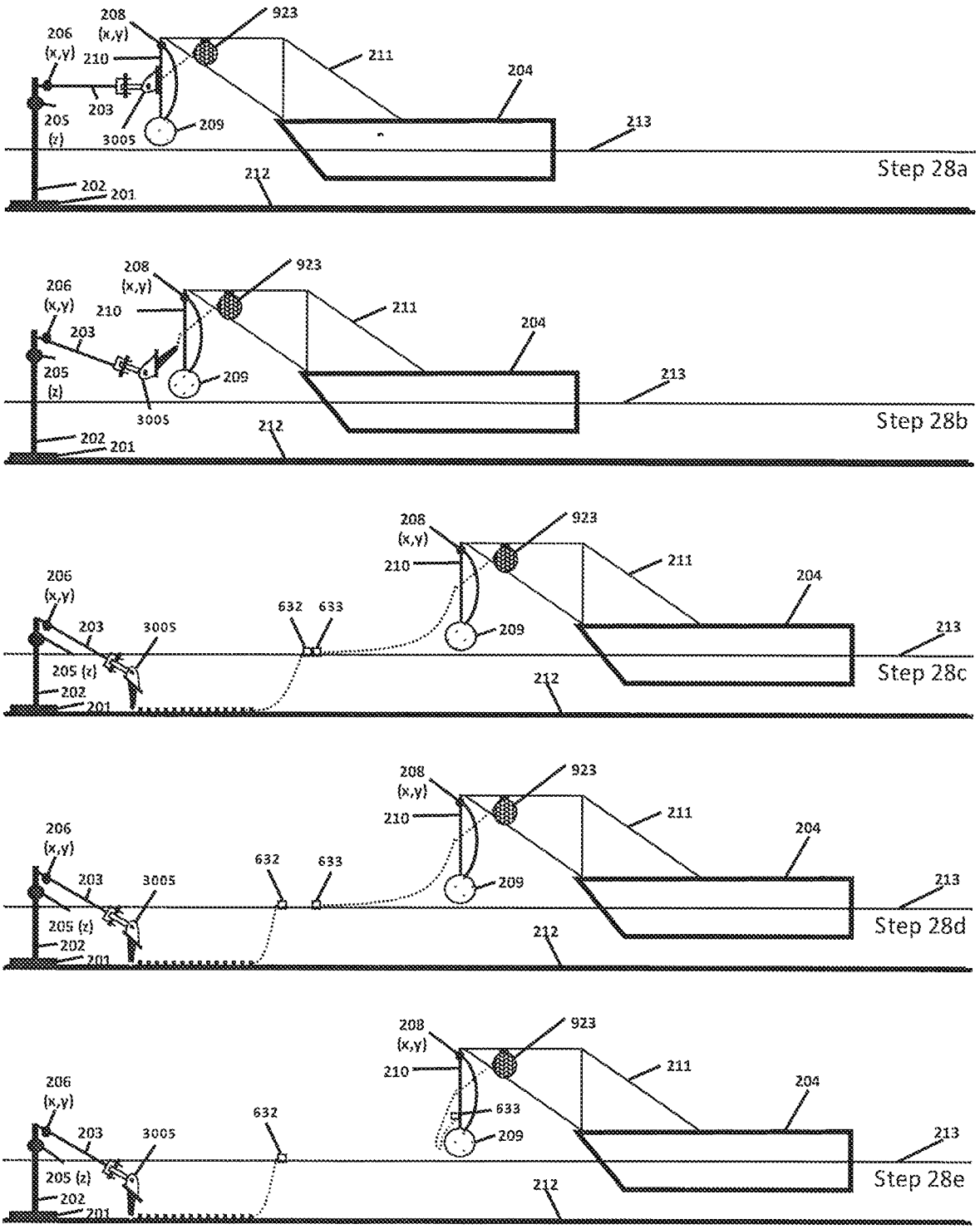

FIG. 29 The Disclosure: Disconnection - Reconnection
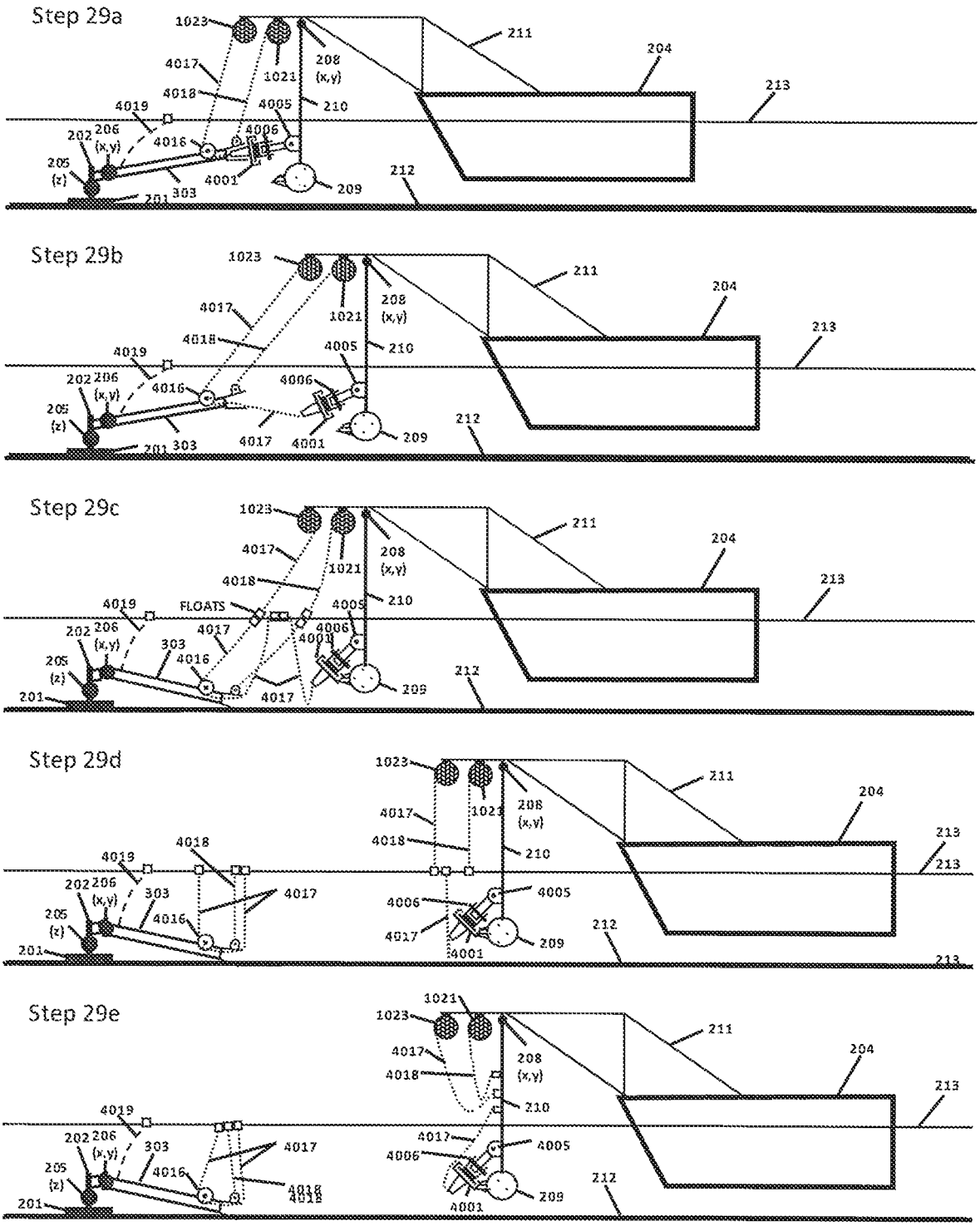

FIG. 30 The Disclosure: Disconnection - Reconnection
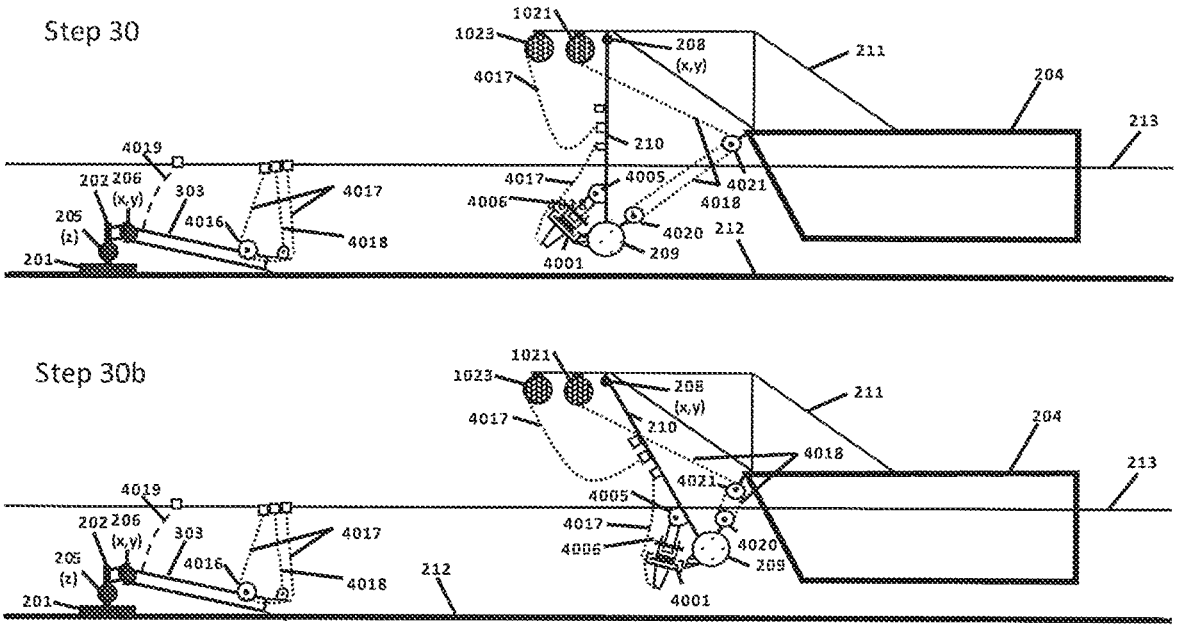

SOFT YOKE MOORING ARRANGEMENT

CROSS-REFERENCE TO RELATED APPLICATIONS

The current application claims priority to U.S. Provisional Patent Application 63/192,190 filed May 24, 2021, the entirety of which is incorporated by reference.

STATEMENT REGARDING FEDERALLY SPONSORED RESEARCH OR DEVELOPMENT

This invention was not made under federally sponsored research or development.

REFERENCE TO SEQUENCE LISTING, A TABLE, OR A COMPUTER PROGRAM LISTING COMPACT DISC APPENDIX

None.

FIELD OF THE INVENTION

Aspects of the disclosure relate to soft yoke mooring systems. Soft yoke mooring systems are comprised of a pendular restoring weight and mechanical linkages or chains which are arranged to maintain a set distance and orientation between a floating structure and earth fixed structure, or between two floating structures, while allowing the floating structure(s) six (6) degrees of motion freedom about said set distance and orientation, in response to the action of wind, waves and current to minimize mooring loads while limiting relative translation and yaw rotation.

BACKGROUND INFORMATION

There exists a number of concepts for mechanically connecting floating structures to earth fixed structures or for connecting two floating structures. For the purpose of this description, they are best differentiated by their load paths, number, degrees of freedom, locations of their hinge points and means for generating restoring forces and moments. For the sake of description, coordinates will be defined as the positive x-direction facing forward from the structure connected to the yoke, positive y-direction to the port or left hand side facing in the positive x-direction and positive z-direction vertically up. FIG. 1 illustrates a representative coordinate system, with earth fixation point (1), earth fixed structure (2), rigid yoke (3) and floating structure (4). With respect to the floating structure (4), the 6 degrees of freedom are termed as follows:

a. Translation:
i.X-direction: Surge.
ii.Y-direction: Sway.
iii.Z-direction: Heave.
b. Rotation:
i.X-Axis: Roll.
ii.Y-Axis: Pitch.
iii.Z-Axis: Yaw.

Different conventional apparatus show the following configurations of mooring systems having mechanical linkages between a floating structure and earth fixed structure or between two floating structures:

a. Single Anchor Leg Storage,
b. Single Anchor Leg Mooring Rigid Arm, and;
c. Soft Yoke Mooring System.

All of these mooring system arrangements are designed to permit the floating structure to have six (6) degrees of motion in response to wind, current and waves within a design envelope limit and depend on a buoyant member in the case of the Single Anchor Leg Storage (a) and Single Anchor Leg Mooring Rigid Arm (b) or a weight as in the case of the Soft Yoke Mooring System (c) in combination with a pendulum, either buoyant and fixed to the sea floor (a) and (b) or weighted and fixed to either the fixed structure or floating structure (c). In embodiments, the pendulum may be suspended by one or two tension members. If suspended by two tension members, for example, the arrangement will exert a moment about the z-axis to restore the floating structure to an orientation of zero yaw angle. Maintenance of the desired distance and orientation between the two structures is achieved by a rigid arm between the pendulum and the other body, relying on the tendency of the pendulum to seek a vertical orientation, due to the action of the weight acting upon them. Concepts have also been put forward which utilize springs, hydraulics, weights or other means to generate the desired restoring forces and moments.

FIG. 2*a* shows the most common, conventional, soft yoke mooring system configuration in perspective view. FIG. 2*b* shows a conventional disconnectable soft yoke mooring system, where disconnection is effected at the connection between the yoke (3) and bearings (6) on the earth fixed structure (2), through a connector (17) while FIG. 3*a* shows the same arrangement at rest in profile. FIG. 3*b* shows the soft yoke mooring system, also in profile, but displaced in the negative x-direction from a resting position to demonstrate its position keeping operating principal. In FIG. 3*b*, the displacement of the floating structure (4) away from the earth fixed structure (2) opens an angle θ. The pendular tension members (10) are suspended from the floating structure fixed structure (11), such that this angle θ operates in concert with the vertical load exerted from weight (9), and in some prior art (15), to create a restoring force equal to the weight of (9) times the sine of the angle θ, as the weight (9) makes the pendular tension members (10) tend to remain vertical.

FIG. 4*a* shows the plain view of the conventional soft yoke mooring system at rest and FIG. 4*b* shows the same system, in plain view, demonstrating translation in the negative y-direction to demonstrate its orientation keeping operating principal. FIG. 4*b* shows the capability of a soft yoke mooring system to permit limited sway motion and limited jackknifing, or yaw angle, at the interface between the mooring support structure (11) and the yoke (3) and weight structure (9). In FIG. 4*b*, the jackknifing or yaw angle is shown as a. In the soft yoke mooring systems, this jackknifing forces one pendular tension member (10) to angle away from the earth fixed location (2) and the opposite pendular tension member (10) to angle toward the earth fixed location. The resulting opposing restoring forces created by this jackknifing creates a couple between pendular tension members (10) which creates a restoring moment about the z-axis which tends to limit the jackknifing angle and maintain the floating structure (4) more or less in line with the axis of the yoke (3).

FIGS. 3*a* and 3*b* show a weight (15) suspended from the yoke structure of a typical soft yoke mooring system.

FIG. 5*a* shows a conventional variant on the soft yoke mooring system shown in the previous FIGS. 2 through 4, in profile. Although the operating principal is exactly the same, in this configuration, the pendular weight (9) and earth yoke (3) are under water. The weight is installed under water to enable the yoke to be installed under water, hence its name submerged yoke. Installing the yoke under water allows its mooring loads to be transmitted lower to the sea floor, which reduces the moments on and the amount of earth fixed structure (2) required to provide an earth fixed attachment point for the mooring system. FIGS. 5*b* and 5*c* show a conventional disconnectable submerged yoke system. In FIG. 5*b*, the link-arms (or chains) are shown separated from the floating structure (4), by removal of the mooring pin (17*a*) from its mooring cradle (17*b*). FIG. 5*c* shows the disconnection process as completed, with the ballast weight (9) and pendular tension members (10) laid on the sea floor (12). The ballast weight (9) is approximately one order of magnitude heavier than the yoke (3). Laying the ballast weight (9) on the sea floor (12) is complicated due to the pitching and heaving action of the floating structure (4). This heaving action can cause the ballast weight (4) to come into contact with the sea floor (12) at a velocity which can cause impact. Further, the pendular tension members (10) may have chains for pull-in, or if made of chain may go slack, resulting in snatch loading. The equipment required for pull-in is sized for the load, so is expensive. Upon reconnection, the same impact and snatch loading may be suffered.

A further disadvantage is illustrated in FIG. 5*d*. It shows that on disconnection, the ballast weight (9) and pendular tension members (10) are laid on the sea floor (12) in the direction of prevailing environmental loads. Although the weather direction may be different at reconnection than it was at disconnection, these components ballast weight (9) and pendular tension members (10) are too heavy to move to orient to the new weather direction, so tugs must be used to orient the floating structure (4) to the disconnect weather direction, to recover the pendular tension members (10). During reconnection, the environment may be pushing against the broad side of the floating structure (4), or toward the earth fixed structure (2), such that if control is lost, the floating structure (4) could allide with the earth fixed structure (2).

FIGS. 6*a* and 6*b* show another conventional variant of the soft yoke mooring system, in profile. Normally, the pendular tension members (10) have universal joints at their upper and lower extremities, providing x-axis and y-axis freedom of rotation, while the yoke ballast weight is rigidly connected to the yoke. In the variant shown in FIGS. 6*a* and 6*b*, a y'-axis hinge (60) is added between the yoke (3) and ballast weight (9). This y'-axis must be in addition to the y-axis hinge at (7), to permit yaw motion of the floating structure (4).

FIG. 7 shows a floating structure (24), floating at the water surface (33) connected to a buoy through a mechanical linkage (23). FIG. 7*a* shows a profile view and FIG. 7*b* shows a plan view. This arrangement features a fulcrum (30) support at mid height by a pin (27) connected through a structure (31) to the floating structure (24), thereby multiplying the restoring force in the x-direction afforded by the pendular weight (29), resulting from the sine of the perturbation angle $\varphi$ acting with that pendular weight (29). In this arrangement, the only z-axis of rotation (25) is at the buoy (19), so environmental forces in the y-direction resulting in sway or yaw can only be accommodated by lateral translation of the buoy. In shallow water, the buoy is stiffer to translation in the x-direction and y-direction than a soft yoke mooring system, so this results in higher y-direction loads on the mechanical linkage. The arrangement has a y-axis hinge (28) between the fulcrum (30) and mechanical linkage (23). The mechanical linkage (23) has an x-axis swivel (26) to permit the vessel to roll, relative to the buoy (19). The arrangement features a buoy (19) moored to the sea-floor (32) at anchor points (21), using anchor legs (22). The buoy (19) provides the mooring arrangement and floating structure (24) with the freedom to rotate about the buoy 19, through a swivel (25), however, the mechanical linkage is rigidly connected to the buoy 19 with respect to translation and rotation about the y-axis. Since, there is no y-axis of rotation at the buoy (19), wave induced buoy trim moments are transmitted into the buoy end of the link-arm (23), further increasing moment loading on the mechanical linkages, about the y-axis. Unlike the soft yoke mooring system, this arrangement does not provide a z-axis rotation and restoring moment at the floating structure (24) end of the link arm (23), so environmental yawing moments induced by the environment, say non-colinear wave, current and winds, exert a very large moment about the z-axis at the pendular (29 and 30) end of the mechanical linkage.

FIG. 8 shows another conventional concept which features a weighted lever arm, or fulcrum (50) and mid-point connection (48) which results in force multiplication, working in concert with weight (49). FIG. 8*a* shows a profile view and FIG. 8*b* shows a plain view. The floating structure (44) is connected through y-axis hinge points (54) to yoke (51). To permit the floating structure (44) to surge and pitch, a y-axis hinge is provided at (47). In the configuration shown in FIG. 8, the link-arm (43) is connected through a y-axis hinge (46) to an earth fixed structure (42) connected to the sea-bed (52) at earth fixation point (41). Between the y-axis hinge (46) and earth fixed structure (42) is installed a z-axis swivel (45) to permit the buoy (55) and floating structure (44) to rotate about the earth fixed structure (42). As this configuration features a z-axis hinge (56) to accommodate sway and jackknifing, there is no z-axis restoring moment, as exists in the soft yoke mooring system configuration, so the floating structure (44) is free to rotate about that z-axis (56) without limit, which may result in contact or allision of the floating structure (44) with the earth fixed structure (42). FIG. 8*c* shows a plan view demonstrating the swaying possible and it is noted that there is no restoring force to prevent this jackknifing angle $\alpha$ from increasing until allision occurs between the floating structure (44) and the earth fixed structure (42). Conventional apparatus also show a configuration in which an earth fixed structure (42) replaces the buoy (55) which avoids this pitfall, by eliminating one of the two z-axes (56 retained with 45 eliminated) present in the configuration shown in FIG. 8.

Finally, FIG. 9 shows another conventional concept with a rigid arm for mooring a floating structure to an earth fixed structure. Both FIGS. 9*a* and 9*b* show profile views of the concept. In this configuration, there exists a swivel (75) free to rotate about the z-axis which allows the floating structure (74) to rotate about the earth tethered structure (72). A yoke (73) is hinged about the y-axis at (78) which allows the floating structure (74) to pitch and heave. The floating structure (74) floats at the water level (83). The yoke (73) is connected to a u-joint with swivel at (75) which allows the floating structure (74) to rotate about the earth tethered structure (72) and pitch, heave and roll. The earth tethered structure (72) is free to tilt about the x and y axis at a base (71) thanks to orthogonal horizontal axes of rotation (76) and at top through orthogonal horizontal axes of rotation (75). The base (71) is earth fixed to the sea floor (82). In this configuration, perturbations, shown in FIG. 9*b*, of the floating structure (74) from its neutral position, shown in FIG. 9*a*, results in deviation of the earth tethered structure (72) from vertical, forming an angle of ø with vertical. A vertical force F (due to buoyancy) or F' (due to mechanical force) is exerted on the earth tethered structure (72). Upon perturbation away from the base (71), the vertical force in concert with the earth tethered structure (72) generates a restoring force (R) equal to F or F' times the sine of the angle (ø) formed by the perturbation, as illustrated in FIG. 9*b*. If the vertical force F' is exerted on the yoke (73), the arrangement is called a single anchor leg storage arrangement. F' may be generated by buoyancy exerted on the yoke (73), counterweight on the opposite end of the hinge point (78), resulting in an upward force or mechanical means installed on the floating structure (74). If the vertical force F is exerted by the buoyancy of the earth tethered structure (72) itself, then the arrangement is called a single anchor leg mooring rigid arm system.

Of the concepts implementing this arrangement, some show the yoke (73) connected to the earth fixed connection point (71) with the tensile member (72) connected to the floating structure (74). The operation of the concept is the same; perturbation of the floating structure (74) results in the vertical tension member (72) forming an angle (ø) with respect to vertical and again a restoring force (R) equal to F or F' times the sine of that angle (ø) is generated. A difference with this permutation of the concept is that with the z-axis freedom of rotation on the floating structure (74) there is no moment restoring force at the floating structure z-axis of rotation, so the floating structure (74) is free to rotate, about the second z-axis on the floating structure (74) which may result in complete jackknifing and allision of the floating structure (74) with the earth tethered structure (72).

Of these arrangements, all utilizing an arm for mooring, the conventional soft yoke mooring system is shown in FIGS. 2 through 5. The soft yoke mooring system has the following features which, in combination, distinguish it from the other mechanical arrangements:

a. A structure (2), fixed to the earth (1) at the sea floor (12) featuring z-axis rotation (5), about which may rotate;

b. A V-shaped yoke (3) which is free to rotate about its x-axis and y-axis at its connection (6) with the earth fixed structure (5).

c. A primary weight (9) which exerts a vertical load on two pendular tension members (10), which have freedom of rotation about the x-axis, y-axis and z-axis at their lower ends (7) and freedom of rotation about the x-axis and y-axis at their upper ends (8). A y-axis hinge may be added to a connections (16), in this configuration, the x, y and z-axis bearings (7) remain installed at the lower end of the pendular tension members (10) and consequently subjected to the full force of the primary weight (9).

d. The primary weight (9) may have a secondary weight (15) hanging from the primary weight (9), through a non-rigid cord or tension member (14), causing the action of the force exerted by the secondary weight (15) to act solely through its point of connection to primary weight (9).

e. The pendular tension members (10) are connected through u-joints (8), providing freedom of rotation about the x-axis and y-axis, which are in turn connected to structure (11) which is fixedly attached to a floating structure (4) which floats at the water surface (13).

This arrangement provides a combination of features not available with the other configurations discussed herein:

a. Z-axis rotation about an earth fixed point (5, 2 and 1) attached to the sea floor (12).

b. An ability for the floating structure (4) to freely roll about the x-axis and pitch about the y-axis, or heave through displacement in the z-direction.

c. Freedom permitting the floating structure (4) to sway in the y-direction, however;

d. With a restoring moment created by the opposing x-direction forces, acting as a couple, created through the rotation about the z-axis, yaw or jackknifing angle in plan view between the pendular tension members (10). This provides the important feature of tending to maintain the orientation of the floating structure (4) relative to the yoke structure (3) tending to be in a colinear arrangement with respect to one another, and thereby allowing a jackknifing perturbation, but within limits which prevent the floating structure (4) from allision with the earth fixed structure (2).

e. When the floating structure (4) is perturbated in the x-direction, in surge, the effect of the weight (9 and possibly 15) acting downward, in combination with the perturbation angle of the tension members (10) results in a restoring force which tends to maintain a constant distance in the x-direction between the earth fixed point (1 and 2) and the floating structure (4).

SUMMARY

So that the manner in which the above recited features of the present disclosure can be understood in detail, a more particular description of the disclosure, briefly summarized below, may be had by reference to embodiments, some of which are illustrated in the drawings. It is to be noted that the drawings illustrate only typical embodiments of this disclosure and are therefore not to be considered limiting of its scope, for the disclosure may admit to other equally effective embodiments without specific recitation. Accordingly, the following summary provides just a few aspects of the description and should not be used to limit the described embodiments to a single concept.

The soft yoke mooring described utilizes two independent ballast weights. The yoke structure is connected to either the ballast weights or their link-arms, each independently connected through x, y and z-axis bearings. Hence, these x, y and z-axis bearings do not support the gravitational load of the yoke ballast weight, but rather primarily transmit mooring loads in the horizontal plane. This reduction in load transmitted across said bearing permits a reduction in their size, weight and cost, while reducing wear and enhancing bearing life.

Because the ballast weights are independent, the x, y and z-axis bearings or connections may be connected to either the ballast weights or their link-arms. If said bearings or connections are connected to the link-arms, a fulcrum effect is created which permits the ballast weight to be reduced while generating the same mooring restoring force. This reduction in ballast weight load transmitted across the upper x and y-axis bearings or connections permits them to be similarly optimized.

Because the gravitational load of the fulcrum configured arrangement is reduced, the mooring support structure may be similarly optimized.

Installing the x, y and z-axis bearings or connections between the yoke and ballast weight or their link-arms provides a convenient location for disconnecting the moored floating structure from the yoke. Since the ballast remains on the floating structure side of the disconnection point, only the yoke remains with the earth fixed structure. The yoke weight is approximately an order of magnitude less than the ballast weight. This means the yoke can be more easily handled than the yoke, link-arm (or chain) and ballast assembly weight during disconnection and reconnection. Further, the yoke may be lifted or deballasted to facilitate favorable reorientation to suit the weather conditions found at reconnection, thereby requiring fewer tugs to maintain floating structure heading and position.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the drawings. It is to be noted, however, that the appended drawings illustrate only typical embodiments of this disclosure and are therefore not to be considered limiting of its scope, for the disclosure may admit to other equally effective embodiments.

FIG. 23 shows the x, y and z-axis bearing assembly of one aspect of the disclosure, with a collet connector to be attached to the ballast weight or fulcrum, angled to facilitate collet connector pull-in.

FIG. 25 shows the disconnection-reconnection storyboard of one aspect of the disclosure, using the bearing assembly of FIG. 21.

FIG. 26 shows the disconnection-reconnection storyboard of one aspect of the disclosure, using the bearing assembly of FIG. 22.

FIG. 27 shows the disconnection-reconnection storyboard of one aspect of the disclosure, using the bearing assembly of FIG. 23, connected to the ballast weight.

FIG. 28 shows the disconnection-reconnection storyboard of one aspect of the disclosure, using the bearing assembly of FIG. 23, connected to the link-arm.

FIG. 29 shows the disconnection-reconnection storyboard of one aspect of the disclosure, using the bearing assembly of FIG. 24.

FIG. 30 shows pull-in for storage of the ballast weight while suspended from the mooring support structure, after disconnection and is a continuation of FIG. 29.

Figure 1:
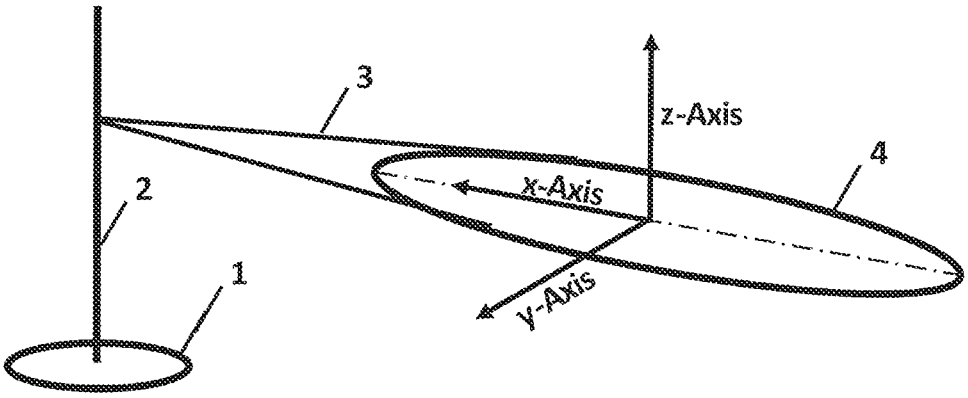
FIG. 1 shows the industry standard coordinate convention used here, in isometric.
Figure 2A:
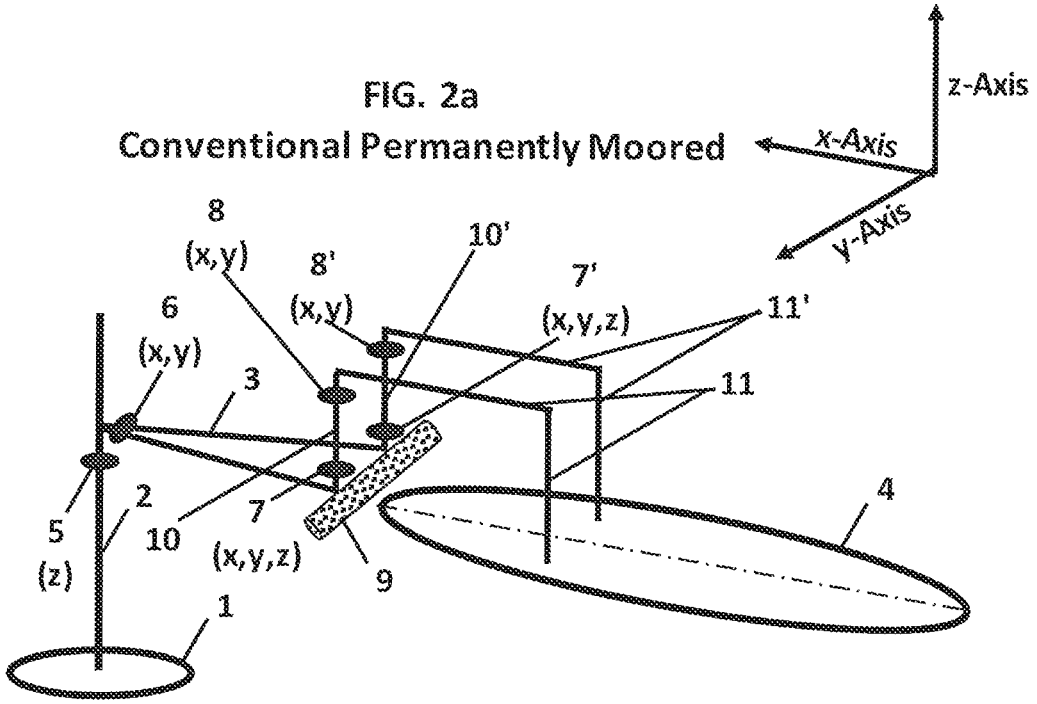
FIG. 2*a* shows an isometric view of a typical conventional permanently moored soft yoke mooring system.
Figure 2B:
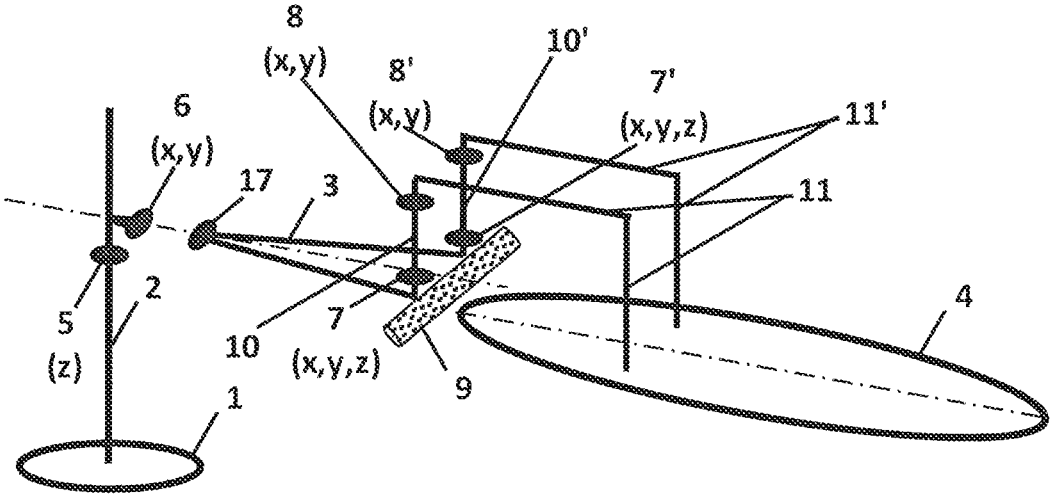
FIG. 2*b* shows an isometric view of a typical disconnectably moored conventional soft yoke mooring system.
Figure 3A:
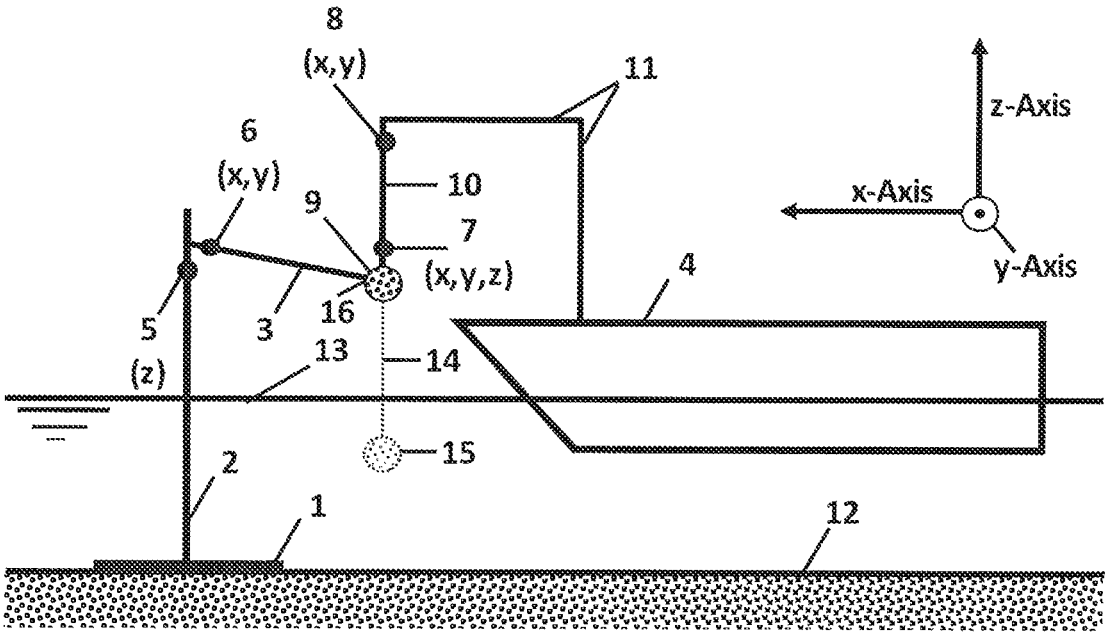
FIG. 3*a* shows a profile view of a typical conventional soft yoke mooring system at rest.
Figure 3B:
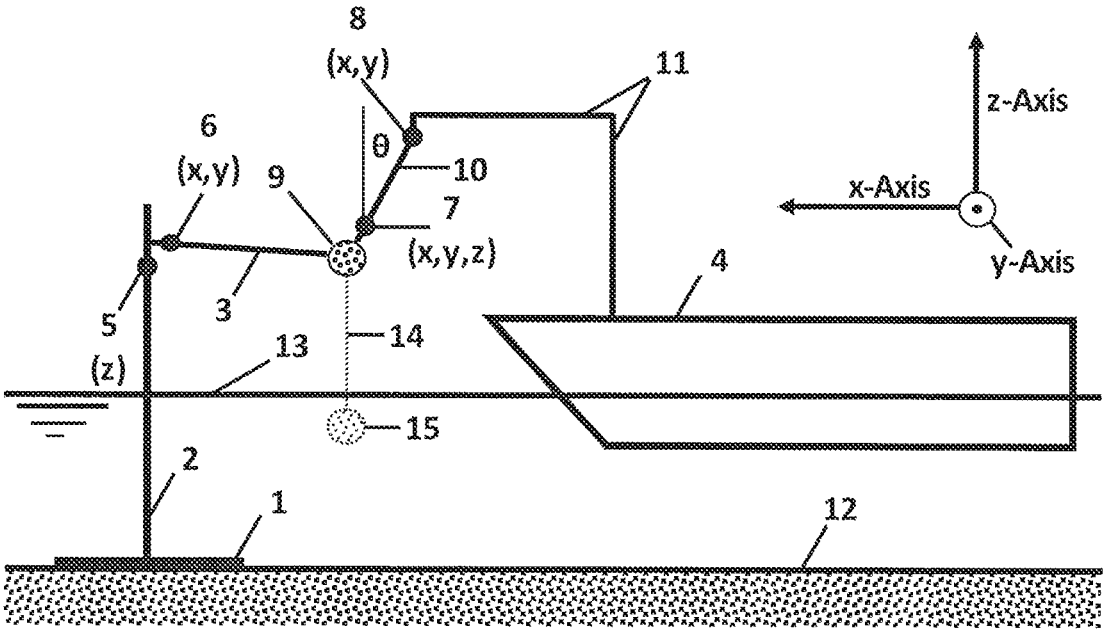
FIG. 3*b* shows a profile view of a typical conventional soft yoke mooring system, displaced by environmental loads to illustrate its operating principal.
Figure 4A:
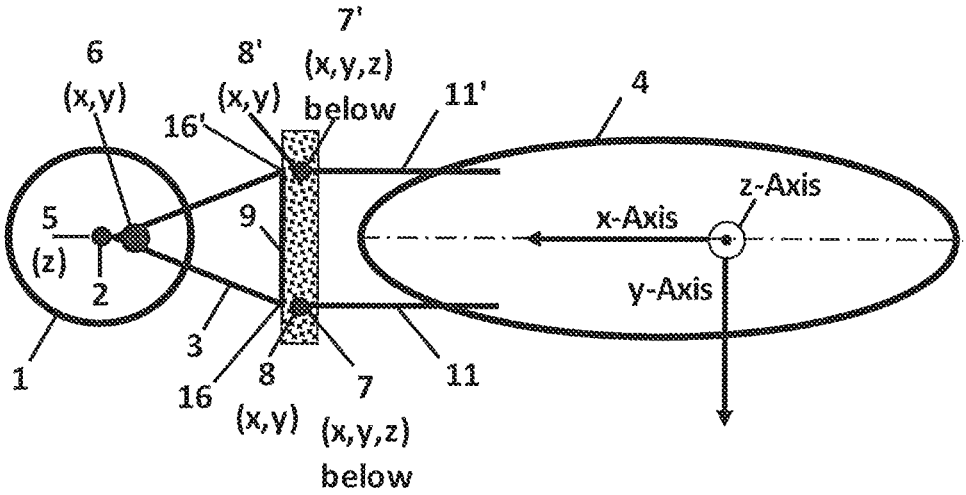
FIG. 4*a* shows a plan view of a typical conventional soft yoke mooring system at rest.
Figure 4B:
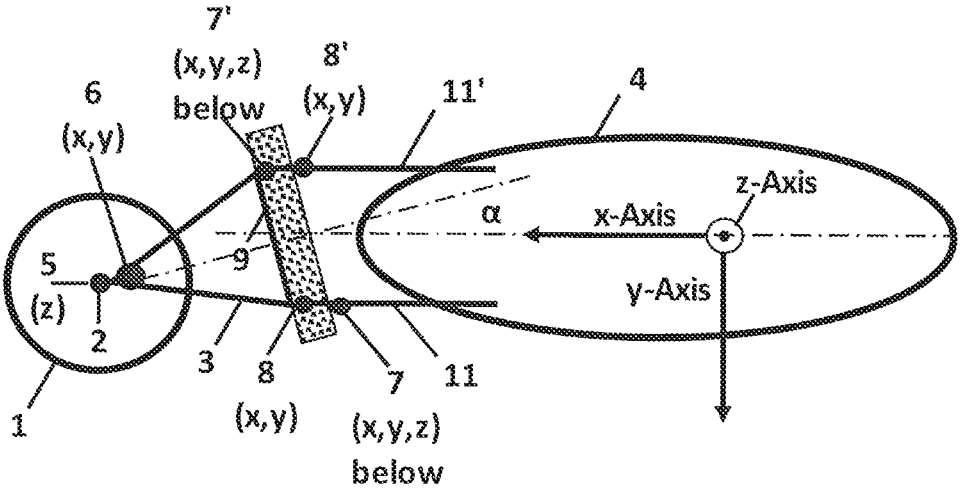
FIG. 4*b* shows a plan view of a typical conventional soft yoke mooring system displaced by environmental loads to a position which creates a yaw angle between the vessel and yoke x-axes.
Figure 5A:
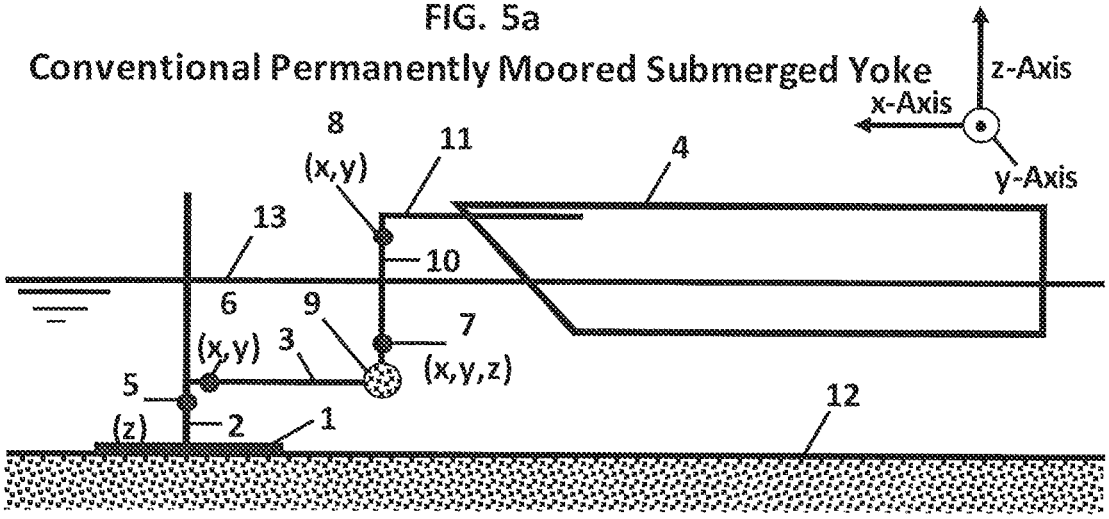
FIG. 5*a* shows a conventional permanently moored submerged yoke system.
Figure 5B:
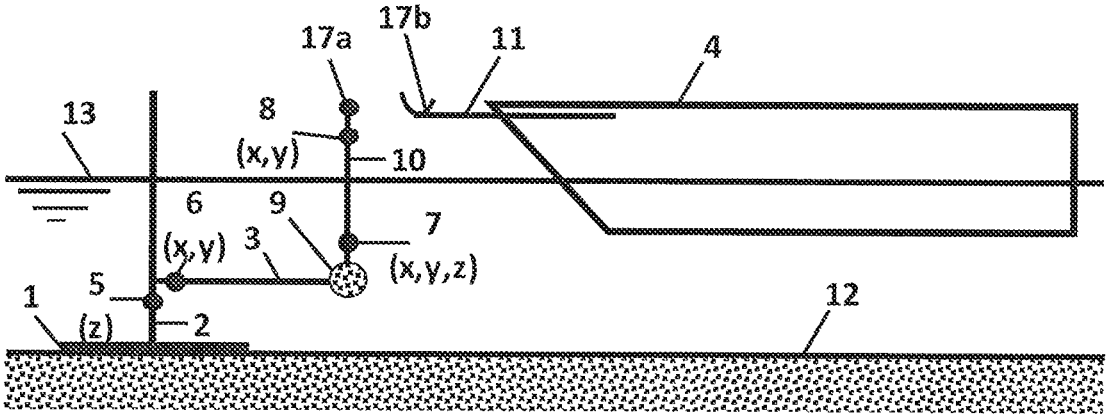
FIG. 5*b* shows a conventional disconnectably moored submerged yoke system, illustrating the connecting pin and mooring cradle of a typical system.
Figure 5C:
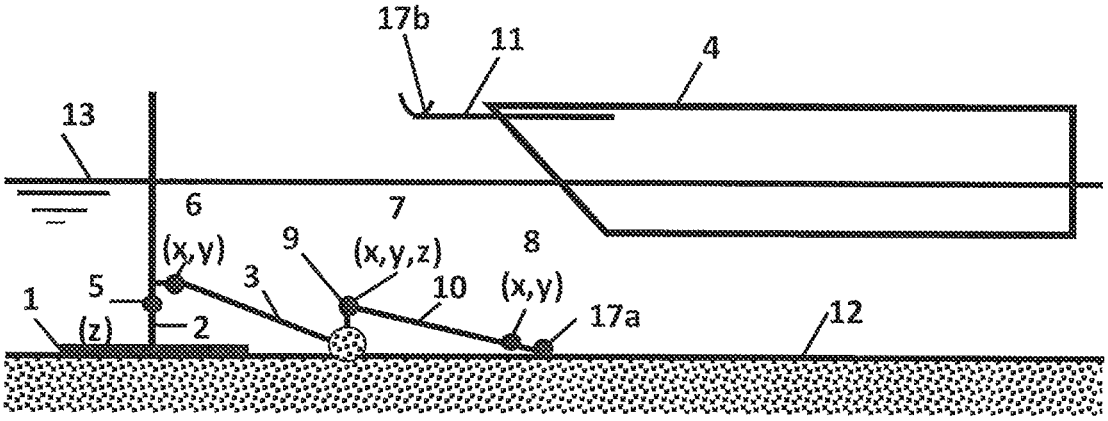
FIG. 5*c* shows a conventional disconnectably moored submerged yoke system, with yoke/ballast weight and link-arm (or chain) assemblies laid on the sea floor.
Figure 5D:
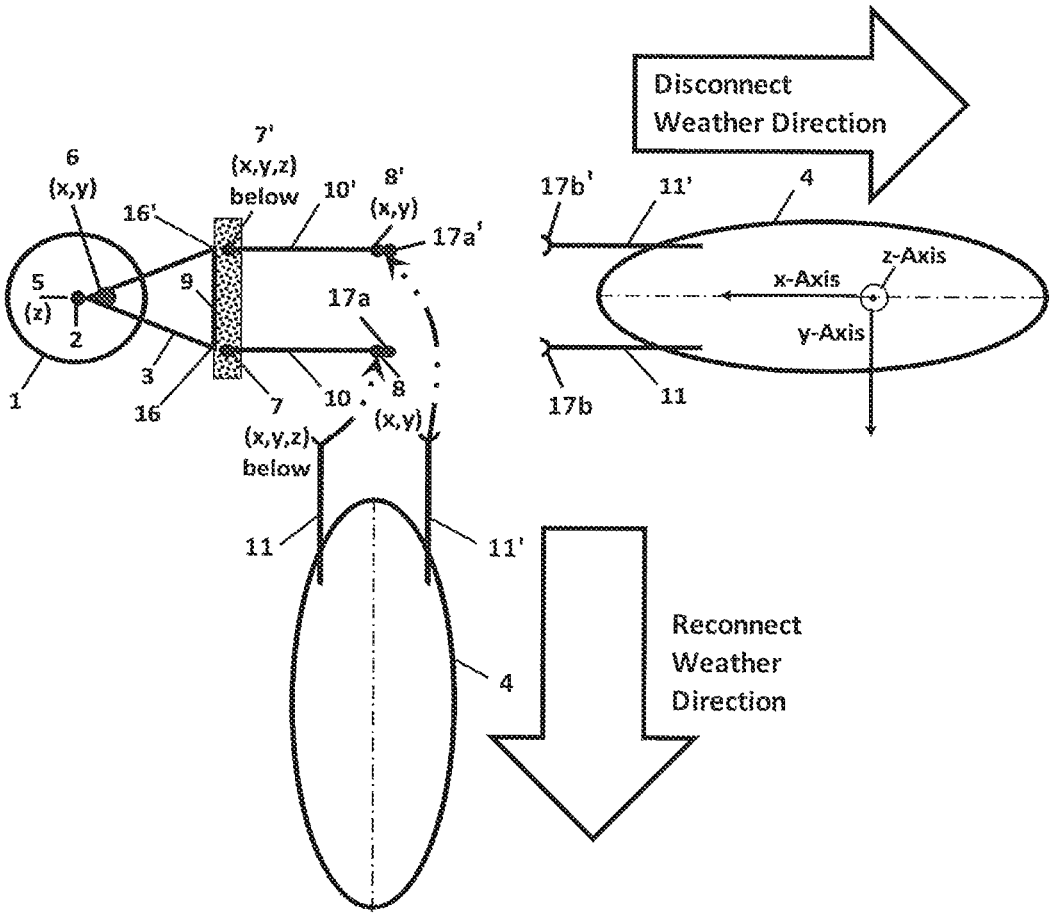
FIG. 5*d* shows a plan view illustrating the challenge posed by a disconnectably moored submerged yoke conventional system, with ballast weight and link-arm (or chain) as typically laid on the sea floor.
Figure 6A:
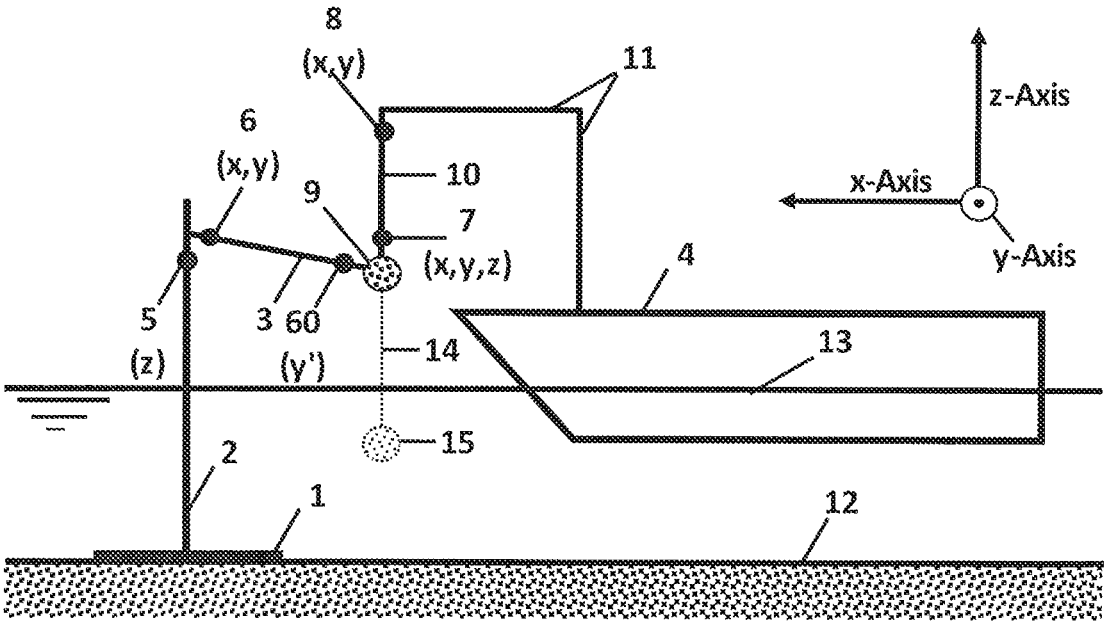
FIG. 6*a* shows a profile view of a typical conventional soft yoke mooring system at rest, having one of its y-axis bearings installed between the yoke and ballast tank.
Figure 6B:
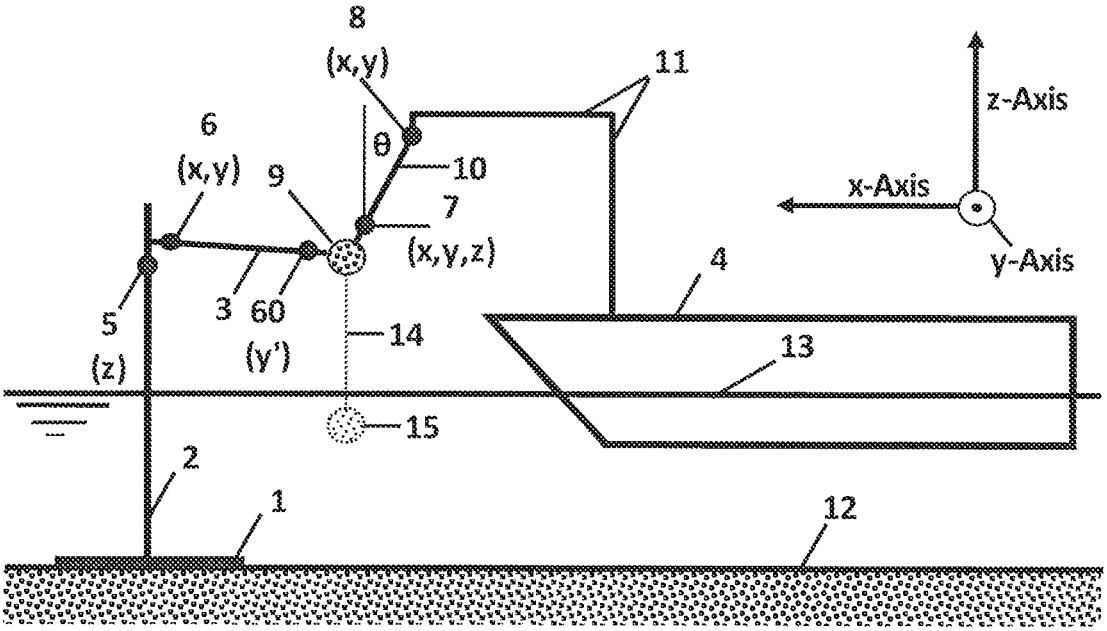
FIG. 6*b* shows a profile view of a typical conventional soft yoke mooring system displaced by environmental loads, having one of its y-axis bearings installed between the yoke and ballast tank.
Figure 7A:
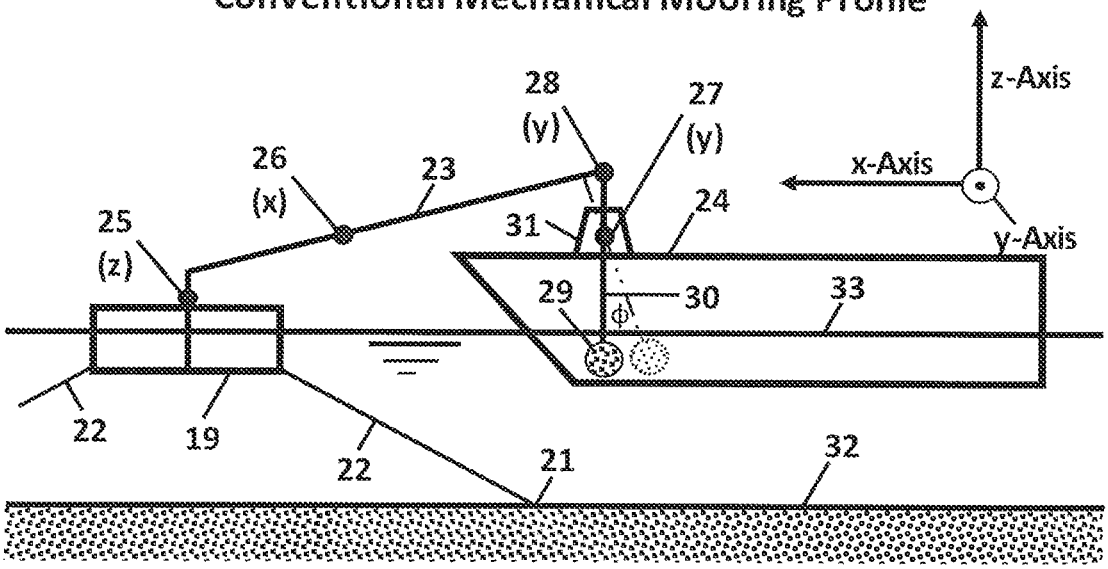
FIG. 7*a* shows a profile view of a conventional mooring system having mechanical linkages and a fulcrum.
Figure 7B:
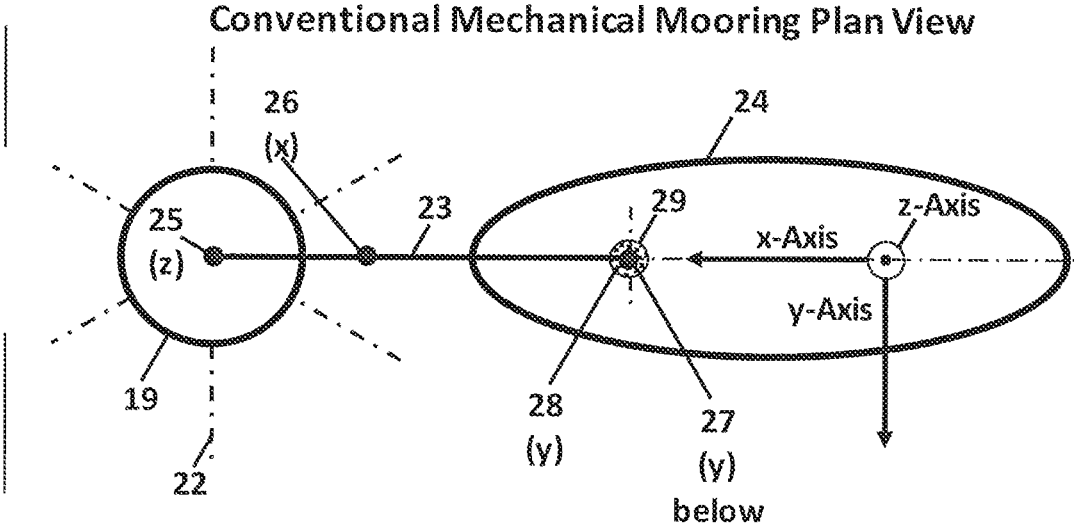
FIG. 7*b* shows a plan view of a conventional mooring system having mechanical linkages and a fulcrum.
Figure 8A:
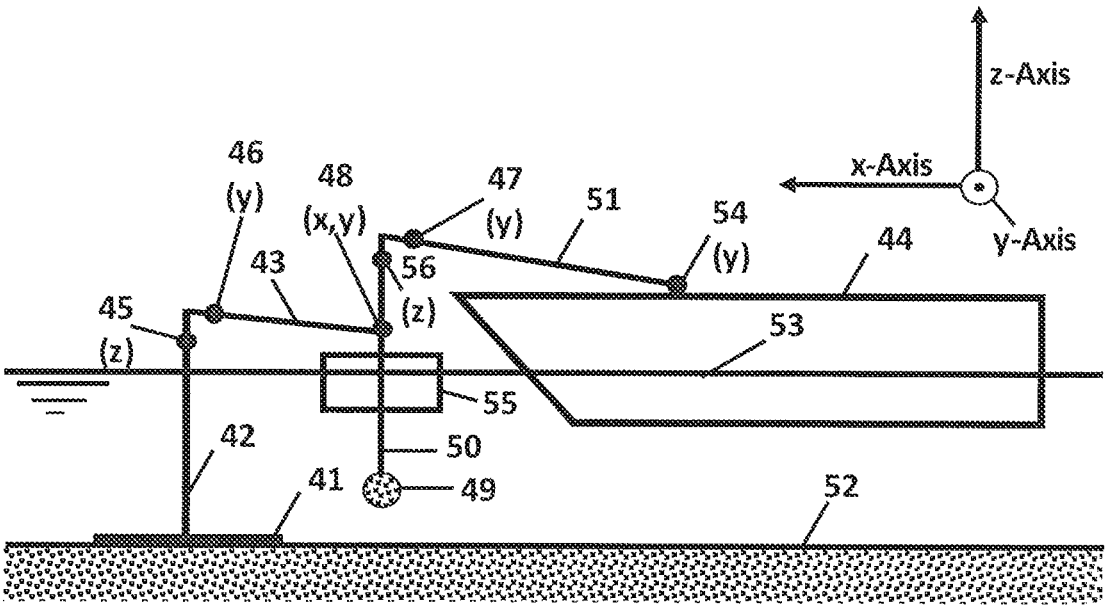
FIG. 8*a* shows a profile view of a conventional mooring system having multiple mechanical linkages and a fulcrum.
Figure 8B:
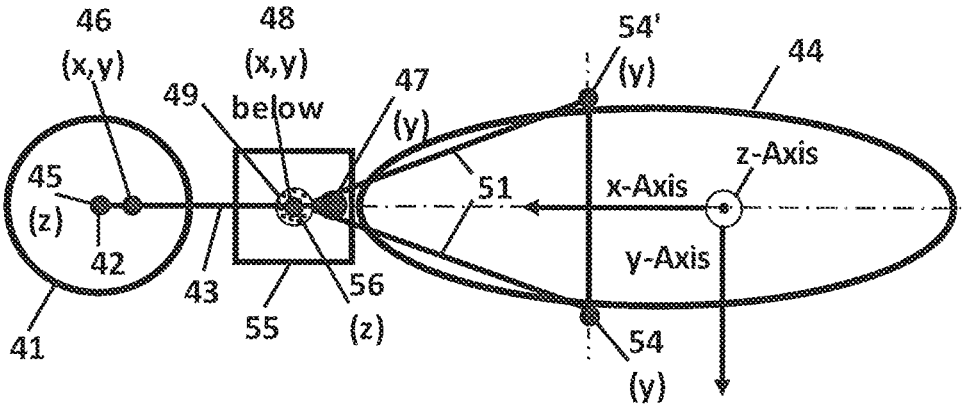
FIG. 8*b* shows a plan view of a conventional mooring system having multiple mechanical linkages and a fulcrum.
Figure 8C:
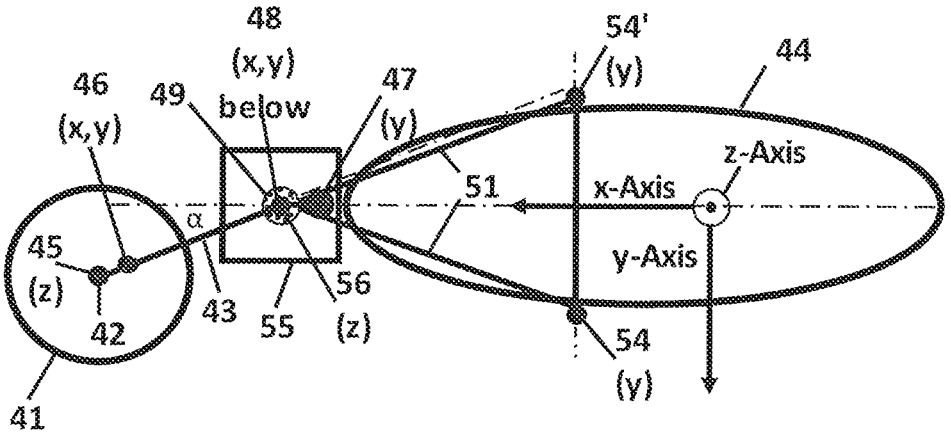
FIG. 8*c* shows a plan view of a conventional mooring system having multiple mechanical linkages and a fulcrum, displaced by environmental loads to a position which creates a yaw angle between the vessel and link-arm x-axes.
Figure 9A:
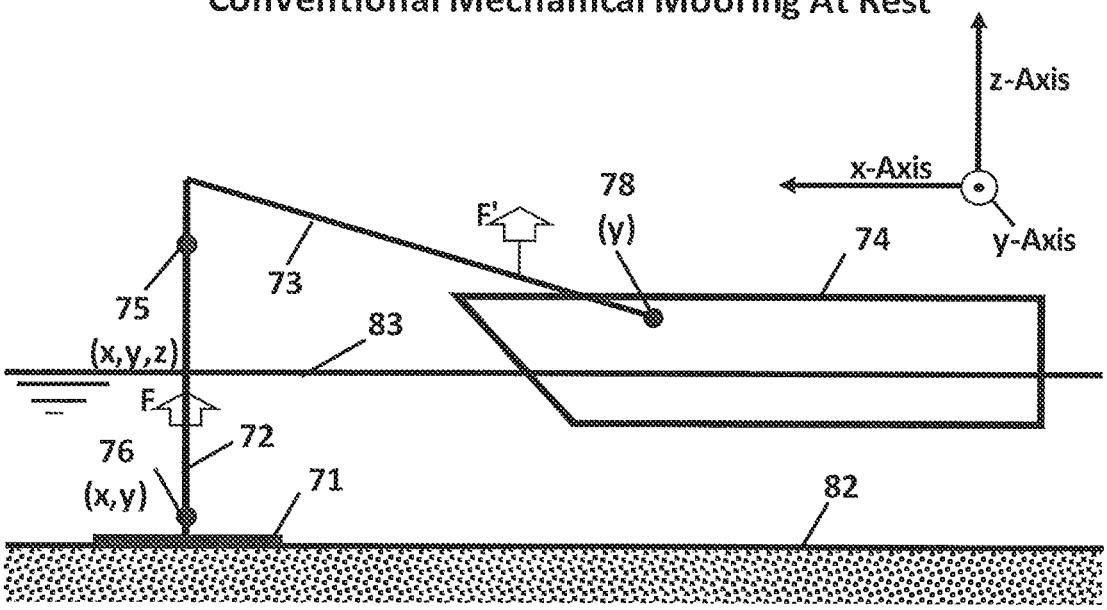
FIG. 9*a* shows a profile view of a conventional mooring system having a yoke mounted on the floating structure at rest.
Figure 9B:
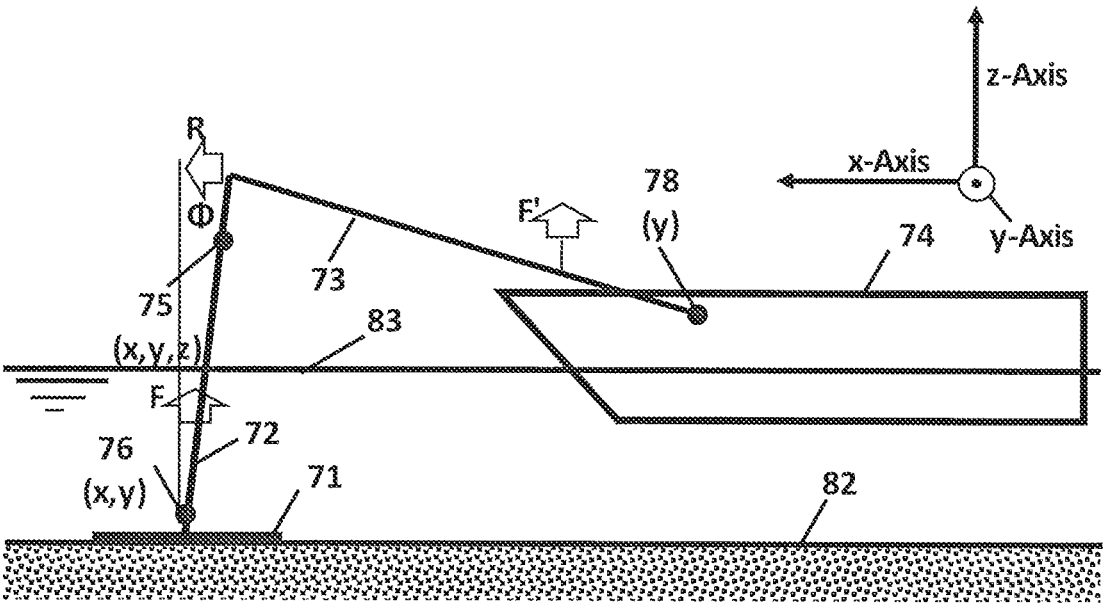
FIG. 9*b* shows a profile view of a conventional mooring system having a yoke mounted on the floating structure displaced by the environment to illustrate its operating principal.
Figure 10:
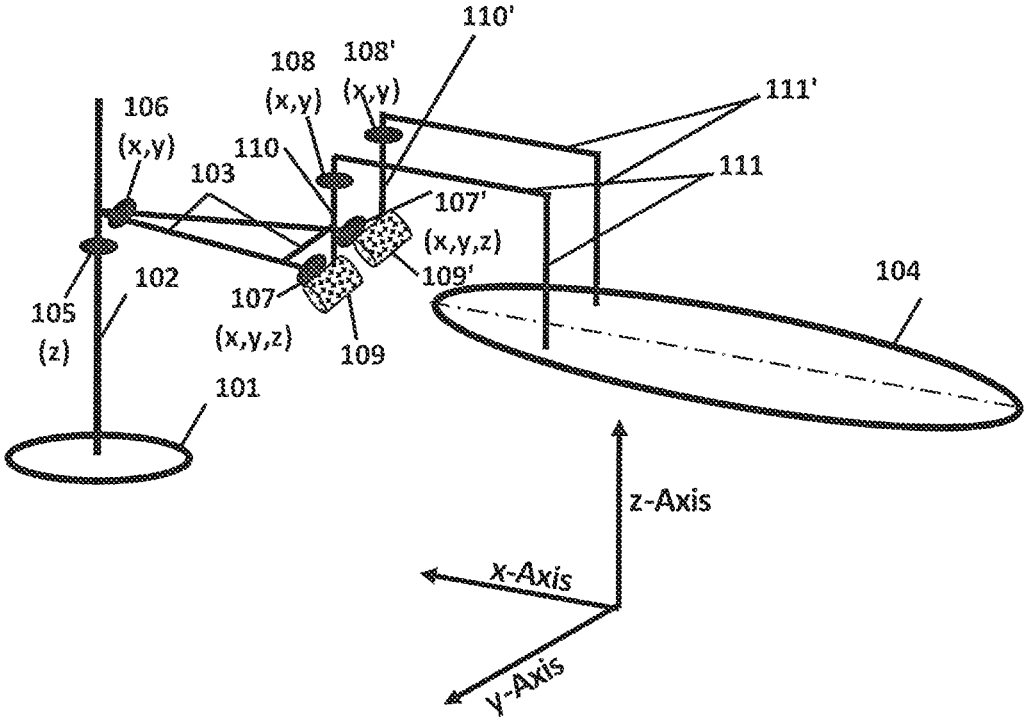
FIG. 10 shows an isometric view of one aspect of the disclosure illustrating independent ballast weights and x, y and z-axis bearings installed between the ballast weight and yoke.
Figure 11:
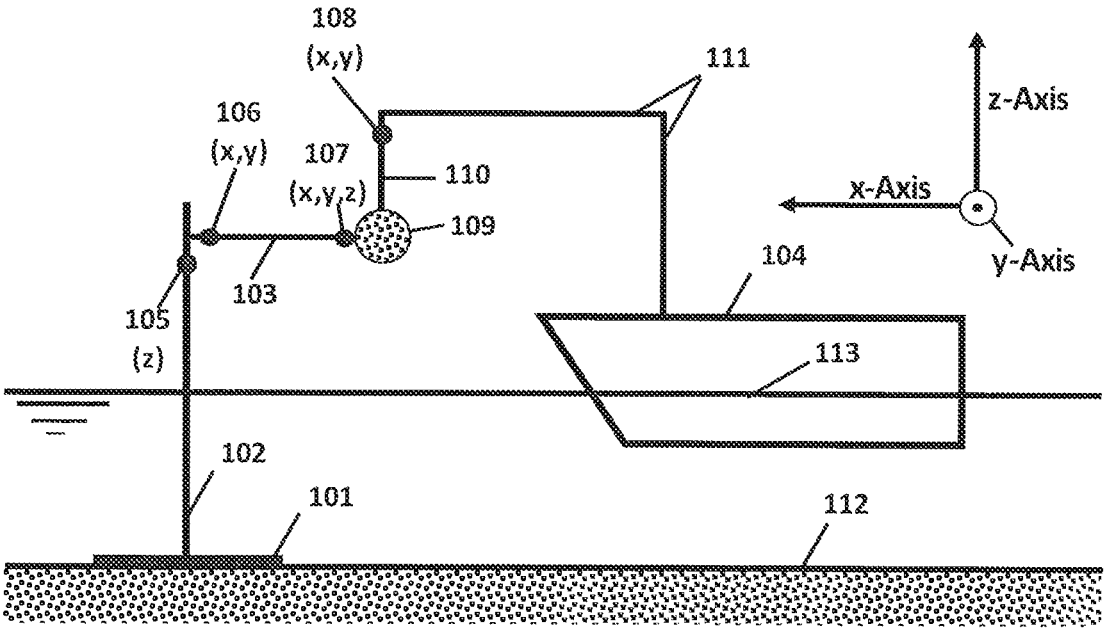
FIG. 11 shows a profile view of one aspect of the disclosure, illustrating the x, y and z-axis bearings installed between the ballast weight and yoke, at rest.
Figure 12:
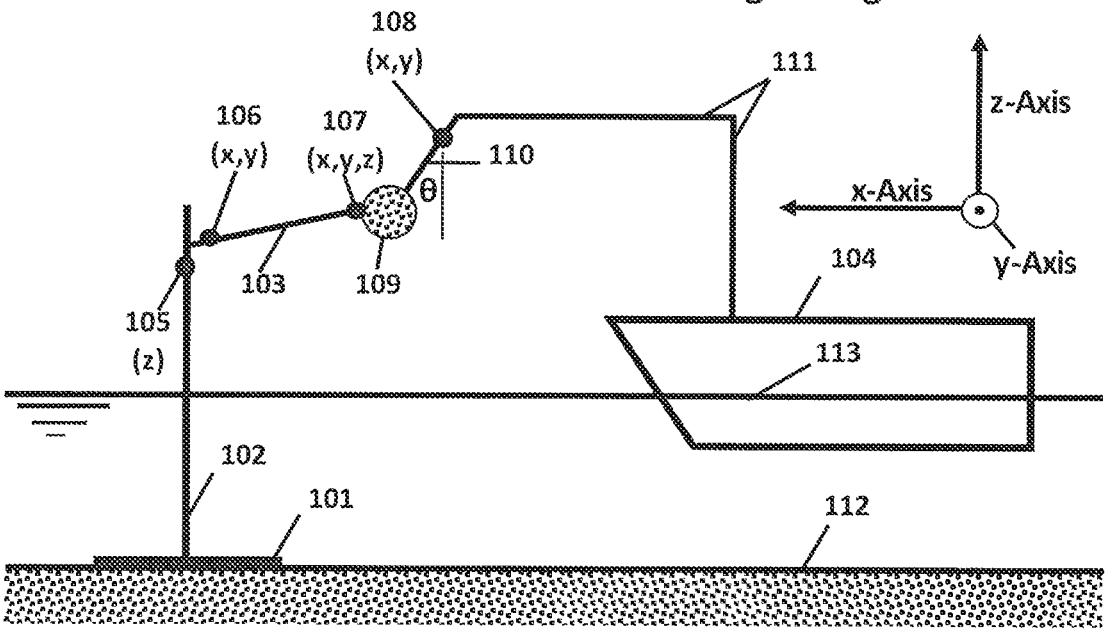
FIG. 12 shows a profile view of one aspect of the disclosure, displaced by environmental loads to illustrate its operating principal.
Figure 13:
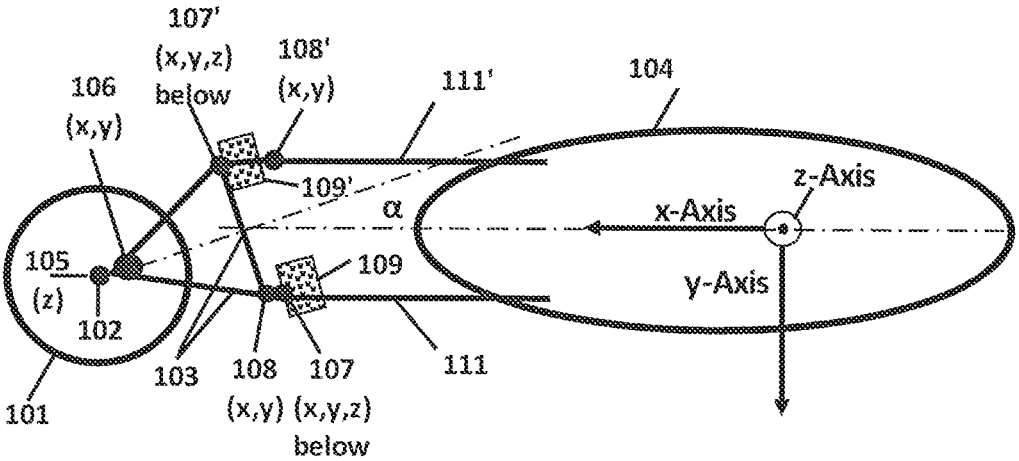
FIG. 13 shows a plan view of one aspect of the disclosure, displaced by environmental loads to a position which creates a yaw angle between the vessel and yoke x-axes.
Figure 14:
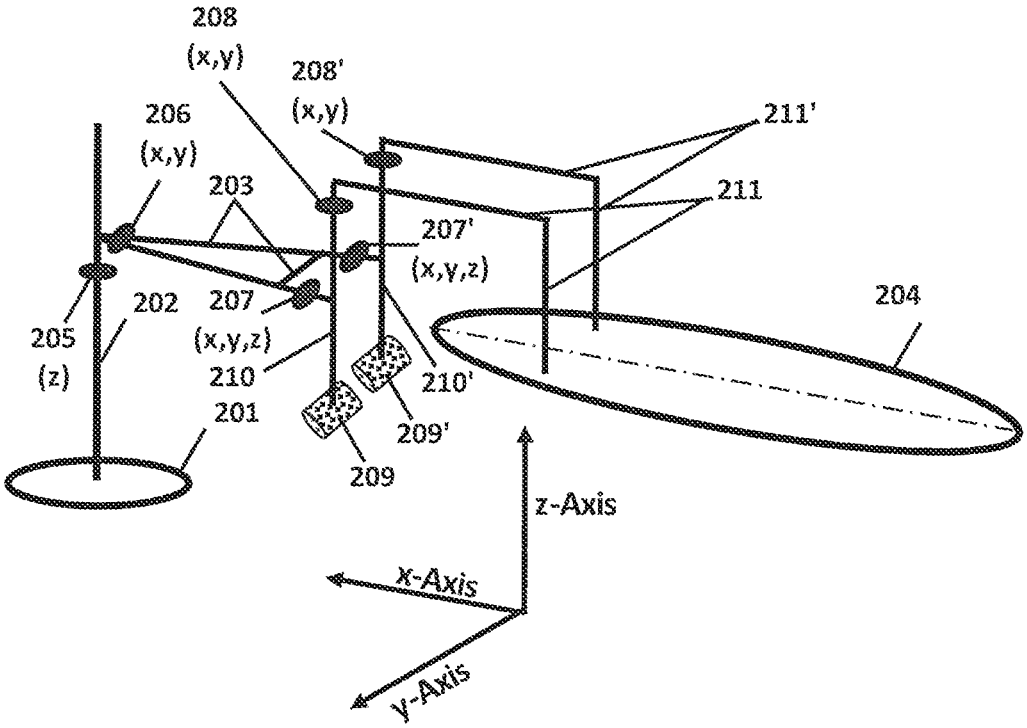
FIG. 14 shows an isometric view of one aspect of the disclosure, with the x, y and z-axis bearings connected to the link-arms, to create a fulcrum.
Figure 15:
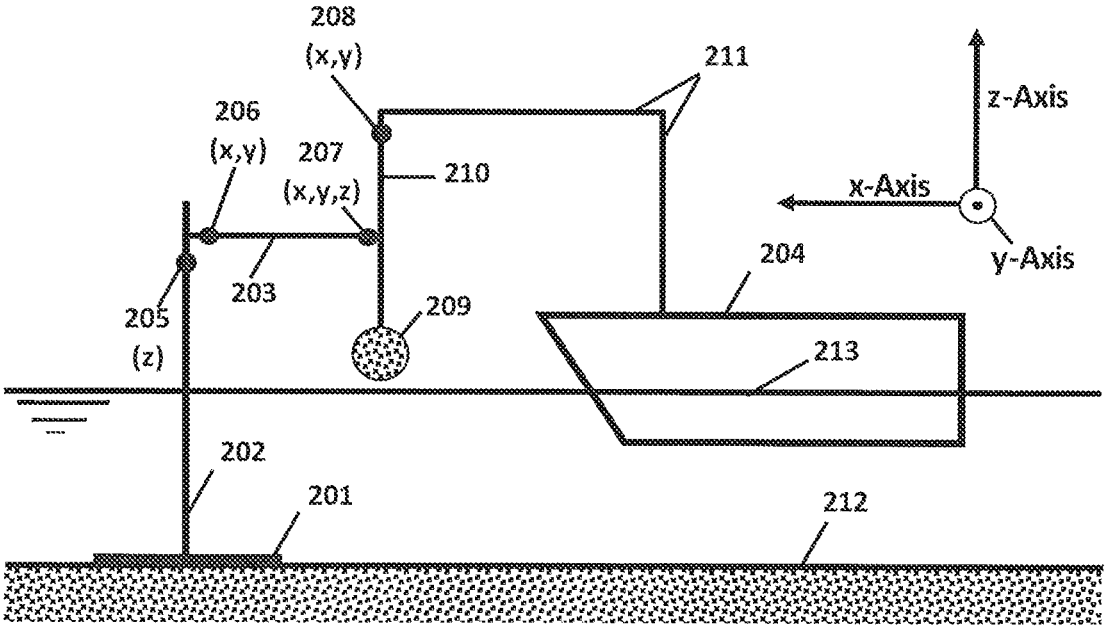
FIG. 15 shows a profile view of one aspect of the disclosure, with the x, y and z-axis bearings connected to the link-arms, to create a fulcrum.
Figure 16:
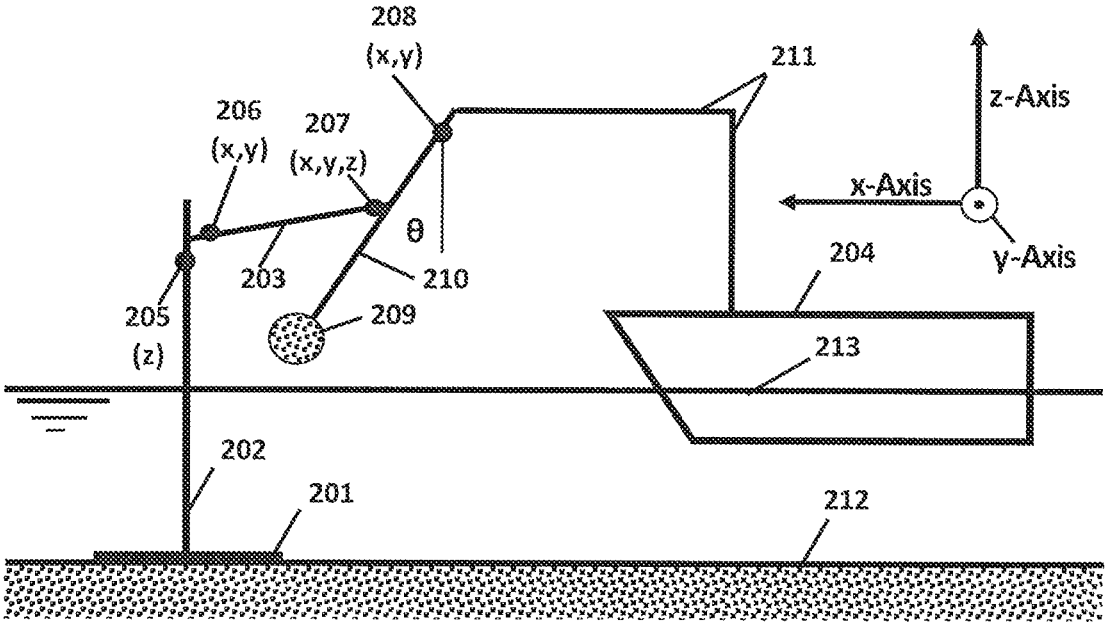
FIG. 16 shows a profile view of one aspect of the disclosure, with the x, y and z-axis bearings connected to the link-arms, displaced by environmental loads to illustrate its operating principal.
Figure 17:
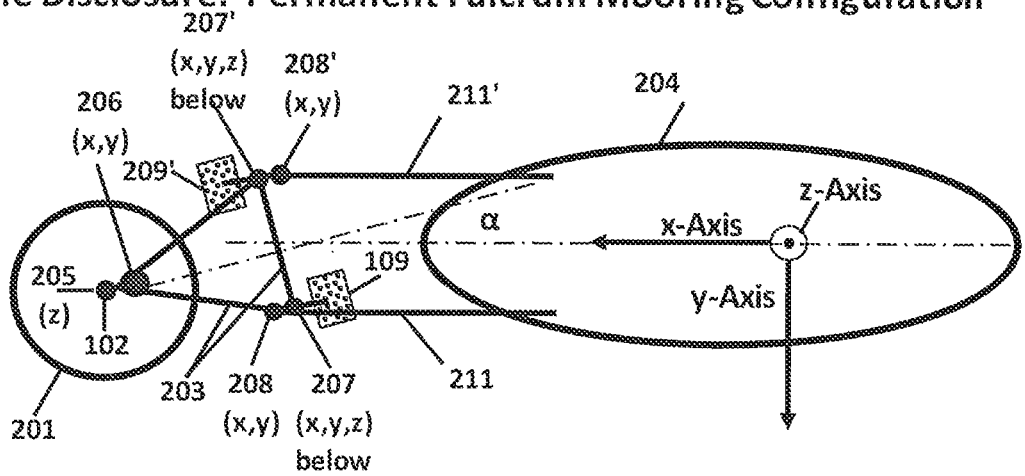
FIG. 17 shows a plan view of one aspect of the disclosure, with the x, y and z-axis bearings connected to the link-arms, displaced by environmental loads to a position which creates a yaw angle between the vessel and yoke x-axes.
Figure 18A:
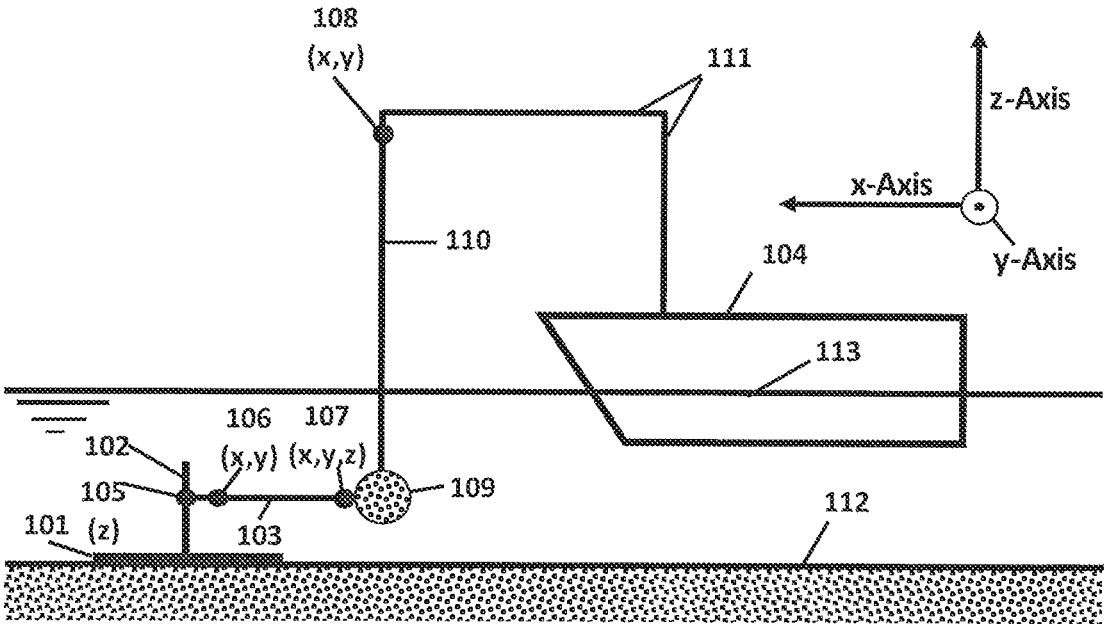
FIG. 18*a* shows a profile of one aspect of the disclosure, in the permanently moored submerged yoke configuration.
Figure 18B:
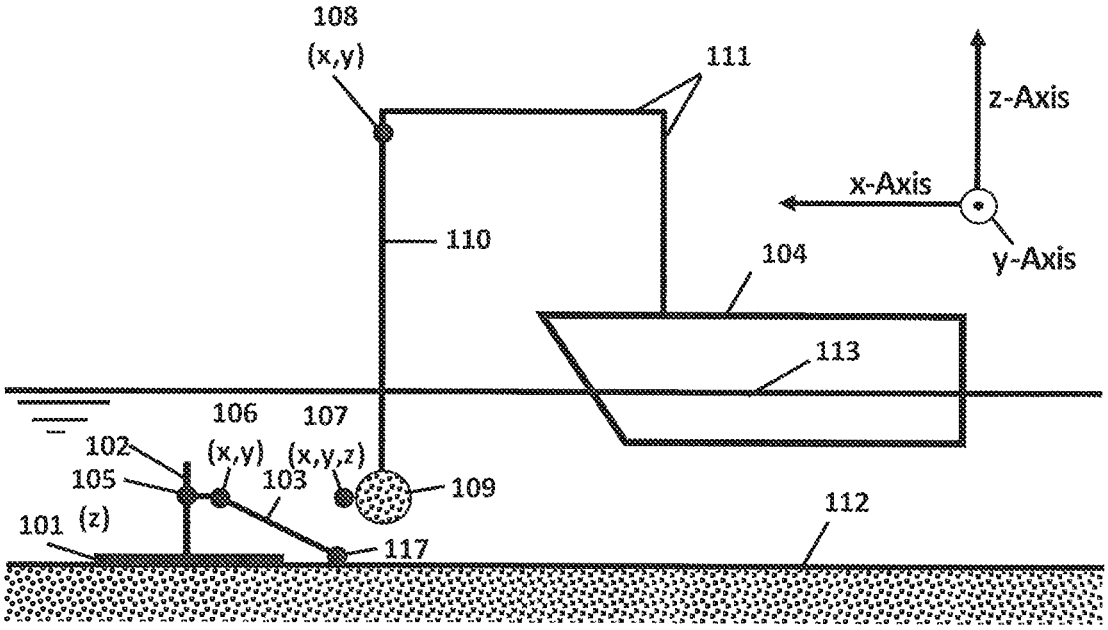
FIG. 18*b* shows one aspect of the disclosure, in the disconnectably moored submerged yoke configuration, with the yoke on the sea floor and the x, y and z-axis bearings and ballast weights remaining attached to the floating structure.
Figure 18C:
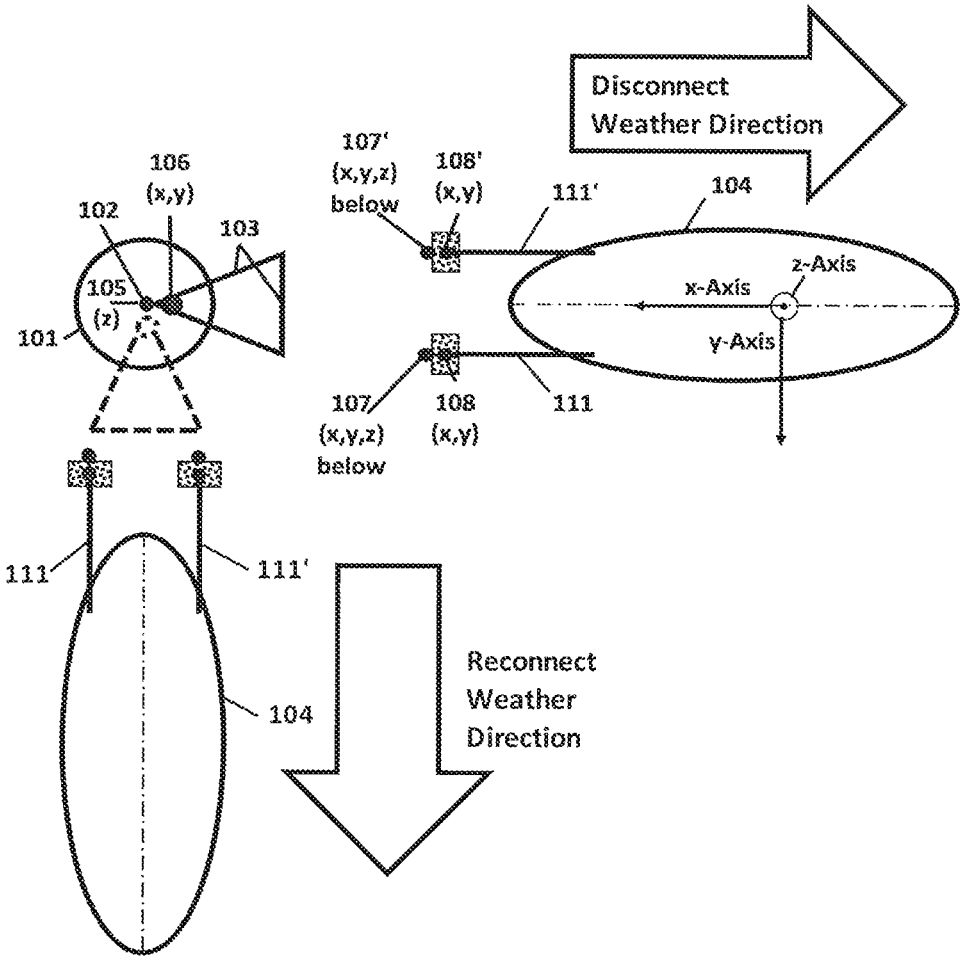
FIG. 18*c* shows a plan view illustrating the ability to reorient the yoke facilitated by configuring disconnectably moored submerged yoke arrangement, with ballast weight and link-arm (or chain) remaining with the floating structure during disconnection.
Figure 19A:
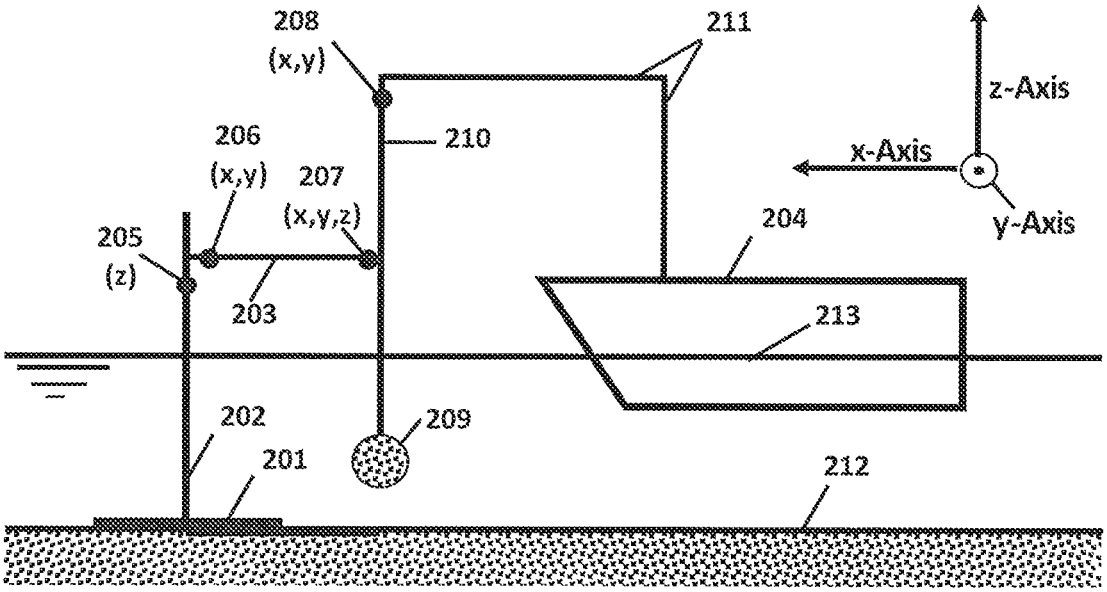
FIG. 19*a* shows a profile view of one aspect of the disclosure in a submerged ballast weight fulcrum mooring configuration.
Figure 19B:
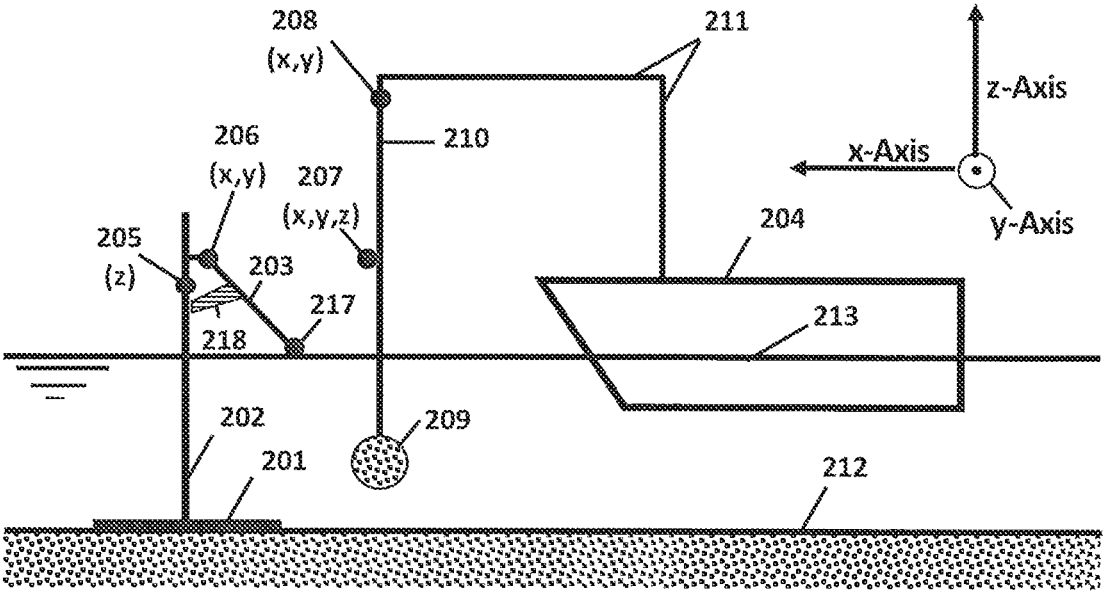
FIG. 19*b* shows a profile of one aspect of the disclosure in a submerged ballast weight fulcrum mooring system in the disconnected condition.
Figure 20:
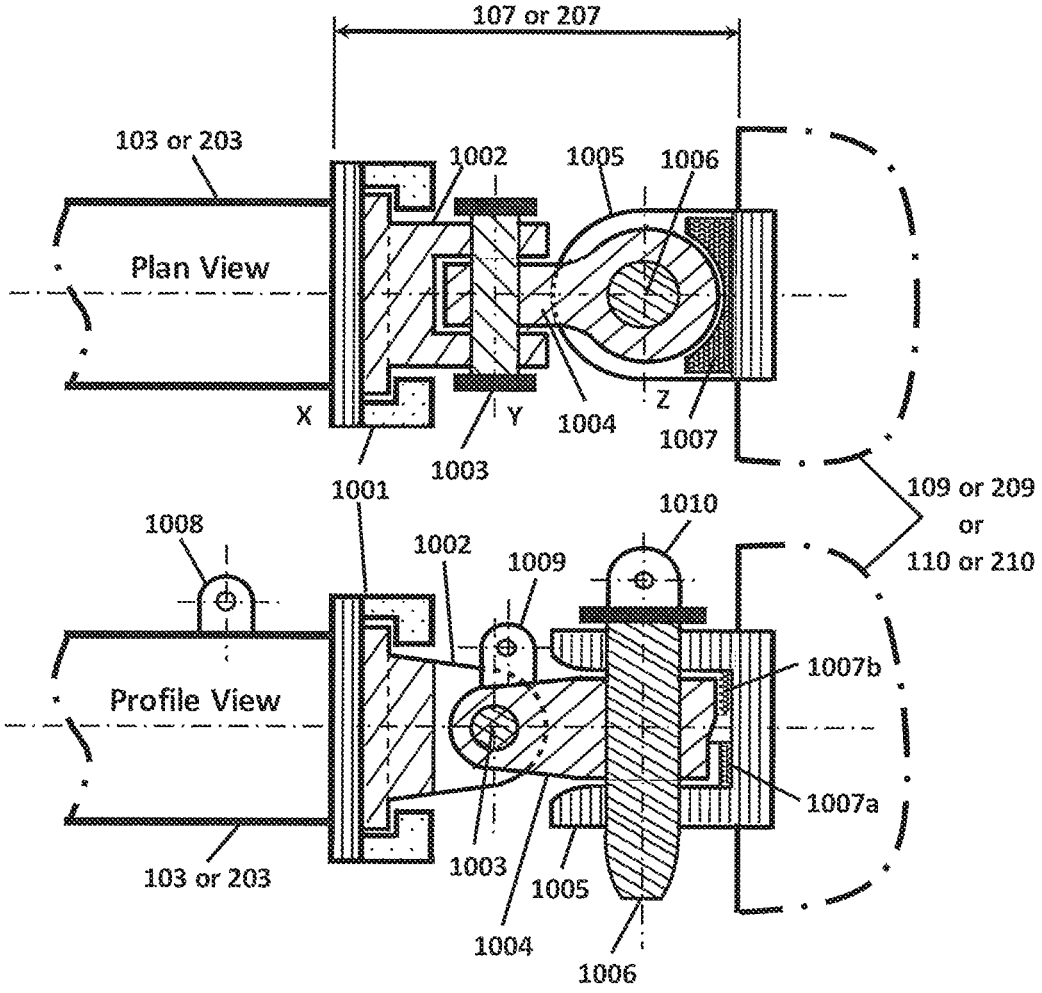
FIG. 20 shows the x, y and z-axis bearing assembly of one aspect of the disclosure, with the removable pin closest to the ballast weight or fulcrum side.

To facilitate understanding, identical reference numerals have been used, where possible, to designate identical elements that are common to the figures ("FIGS"). It is contemplated that elements disclosed in one embodiment may be beneficially utilized on other embodiments without specific recitation.

DETAILED DESCRIPTION

In the following, reference is made to embodiments of the disclosure. It should be understood, however, that the disclosure is not limited to specific described embodiments. Instead, any combination of the following features and elements, whether related to different embodiments or not, is contemplated to implement and practice the disclosure. Furthermore, although embodiments of the disclosure may achieve advantages over other possible solutions and/or over the prior art, whether or not a particular advantage is achieved by a given embodiment is not limiting of the disclosure. Thus, the following aspects, features, embodiments and advantages are merely illustrative and are not considered elements or limitations of the claims except where explicitly recited in a claim. Likewise, reference to "the disclosure" shall not be construed as a generalization of inventive subject matter disclosed herein and shall not be considered to be an element or limitation of the claims except where explicitly recited in a claim.

Although the terms first, second, third, etc., may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first", "second" and other numerical terms, when used herein, do not imply a sequence or order unless clearly indicated by the context. Thus, a first element, component, region, layer or section discussed herein could be termed a second element, component, region, layer or section without departing from the teachings of the example embodiments.

When an element or layer is referred to as being "on," "engaged to," "connected to," or "coupled to" another element or layer, it may be directly on, engaged, connected, coupled to the other element or layer, or interleaving elements or layers may be present. In contrast, when an element is referred to as being "directly on," "directly engaged to," "directly connected to," or "directly coupled to" another element or layer, there may be no interleaving elements or layers present. Other words used to describe the relationship between elements should be interpreted in a like fashion. As used herein, the term "and/or" includes any and all combinations of one or more of the associated listed terms.

Some embodiments will now be described with reference to the figures. Like elements in the various figures will be referenced with like numbers for consistency. In the following description, numerous details are set forth to provide an understanding of various embodiments and/or features. It will be understood, however, by those skilled in the art, that some embodiments may be practiced without many of these details, and that numerous variations or modifications from the described embodiments are possible. As used herein, the terms "above" and "below", "up" and "down", "upper" and "lower", "upwardly" and "downwardly", and other like terms indicating relative positions above or below a given point are used in this description to more clearly describe certain embodiments.

FIGS. 10 through 17 show one example non-limiting embodiment of an arrangement of the disclosure. As will be understood by a person of skill in the art, as used on the detailed description, when the term of a "connection" is described, different types of structural connections may be substituted. As such, when the use of the word "bearing" is presented, if the description discloses that the "bearing" has two degrees of freedom, two different bearings may be used to provide the required degrees of freedom. As will be also understood, a different type of "connection" may be used, not using a "bearing" but providing the necessary number of degrees of freedom discussed. Compared with the conventional soft yoke mooring system, described above, aspects of the disclosure provided herein have a soft yoke mooring arrangement with specific modifications:

f. The single ballast weight (9) of conventional apparatus described above in relation to FIGS. 1 to 9 is replaced by two independent weights (109, 209). This allows each weight (109,209) to swing independently and provide restoring loads and moments exactly as described in the soft yoke mooring system, however, since the two weights (109,209) are separate from one another on the floating structure side (104,204), they are not obligated to rotate about the z-axis relative to the floating structure (104,204) and support structure (111,211), as was the case with the single ballast weight (9).

g. Compared to the conventional systems shown in FIGS. 2 through 5, the x-axis and y-axis hinges and z-axis swivels (7) are moved from the pendular tension member load path, just above the ballast weight (9) to between the yoke (103, 203) and ballast weight (109,209), with the swivel providing freedom of rotation about the x-axis now integral with the yoke. The x-axis and y-axis hinges and z-axis swivel (107, 207) are therefore not in the load path supporting the weights (109,209) and only carry the restoring force loads which is a fraction of the weight load. This enables a reduction in the wear, size, weight and cost of those components (107,207).

h. In lieu of pendular tension members (110) to support the ballast weight (109), two independent rigid pendular tension member fulcra (210) may be employed which are capable of withstanding not only tension, but bending as well. These rigid pendular tension member fulcra (210) are attached fixedly to the weights (209) and are free to swing about the x-axis and y-axis at upper rigid pendular tension member fulcra hinge points (208), but not free to rotate about the z-axis relative to the floating structure (204) and support structure (211). The advantage of this embodiment is that the rigid pendular tension member fulcra (210) may then act as fulcra in cooperation with their respective weights (209), such that the restoring force transmitted through the x, y and z-axis bearings is multiplied. Taking advantage of this force multiplication fulcrum effect, the amount weight in ballast weights (209) required may be reduced for the mooring restoring force, which reduces the load on the x and y-axis bearings (208) and mooring support structure.

FIGS. 14 through 17 and 19 show another non-limiting embodiment of the disclosure. In these FIGS., since the tension members (207) are fixedly attached to their respective weights (209), and are capable of withstanding both tension and bending, the yoke (203) may be connected through the hinges and swivel assemblies (207) at any point between the weights (209) and the hinge assemblies (208). This results in a reduction in the weight of the two weights (209) for the same restoring forces. That reduction in weight, allows further reduction in the load path components (208), resulting in further weight and cost reduction.

The separation distance between the two weights (109, 209) is maintained by y-axis direction forces transmitted through the hinges and swivel assemblies (107,207) which are attached to the yoke (103,203). Yoke (103,203) is a rigid isosceles triangular member where opposing sides transmit mooring loads, and base ties hinges and swivel assemblies (107,207) together in the y-direction.

Because the gravity load of the weights (109,209) are not transmitted by the hinges and swivel assemblies (107,207), the z-axis pin of (107,207) may be removed for disconnection of the floating structure (104,111 or 204,211) from the yoke (103,203), more easily than in arrangements where the disconnection and reconnection is made between the mooring support structure (11) and pendular tension members (10). A collet connector (3011, 3012, and 3014 or 4011, 4012 and 4014) may be utilized to serve as the point at which the disconnection and reconnection is made between the yoke (103 or 203) and the remainder of the x, y and z-axis bearing assembly (107 or 207).

The arrangement of the disclosure shown in FIGS. 10 through 15 may be lowered beneath the surface of the sea, in a fashion analogous to arrangement shown in FIG. 5. This is shown in FIGS. 18, 19, 26 and 29.

When used in a disconnectable soft yoke mooring system, the disclosure has further advantages. The aspects of the disclosure facilitate disconnection and reconnection at the x, y and z-axis bearing assembly, leaving the yoke (103,203) with the earth fixed structure (102,202). Since it is approximately 1/10 the weight of the ballast weight (109,209), it is more easily handled, with lighter and cheaper pull-in equipment. The yoke (103,203) is also more easily rotated to facilitate reconnection if the prevailing weather direction changes from disconnection to reconnection, as illustrated by comparing FIG. 5*d* with FIG. 18*c*. If submerged, the yoke may be lifted and rotated, or deballasted by injecting air into the yoke (303) through an air-hose (4019) as shown in FIG. 29 and then rotated in a floating condition.

Figure 21:
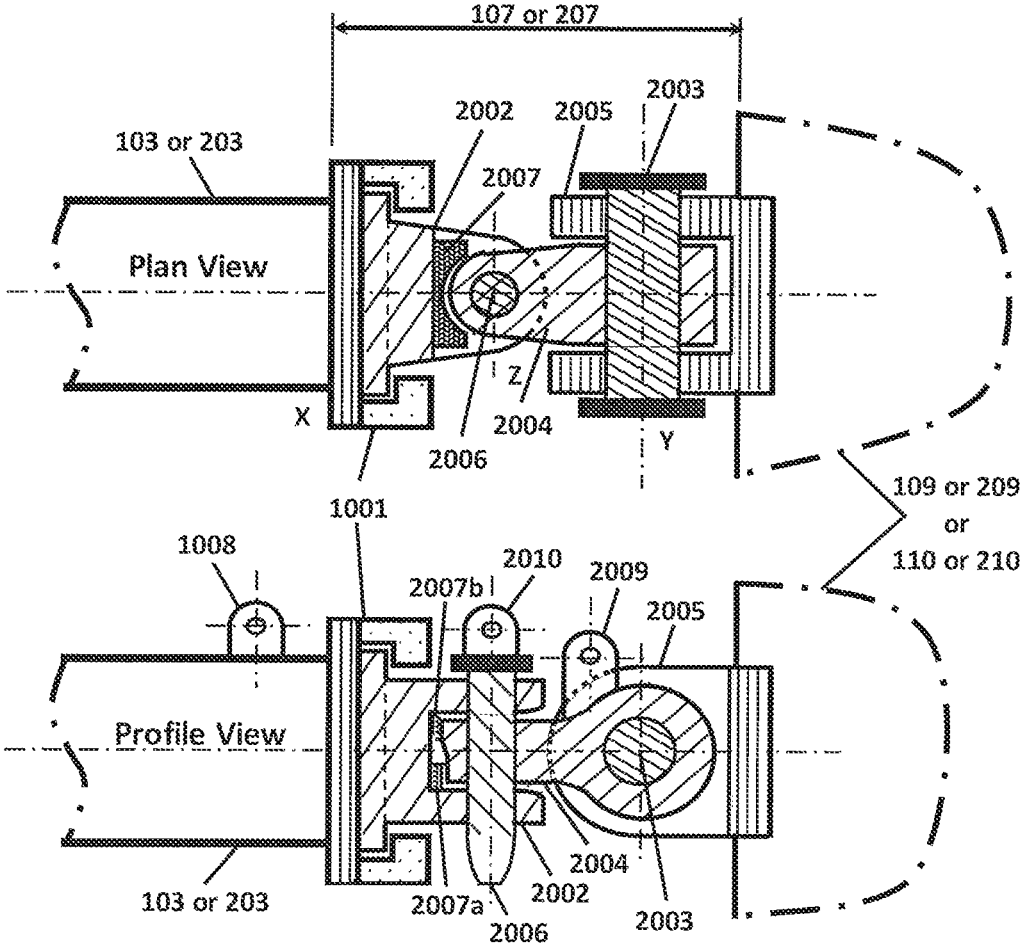
FIG. 21 shows the x, y and z-axis bearing assembly of one aspect of the disclosure, with the removable pin closest to the yoke side.

The disconnection can be made at the z-axis pin (2006) of FIGS. 21 and 25, through coordination of winches (621, 622 and 623) and leaving ropes after sail-away on buoys (630 and 631), as shown in steps 25*a* through 25*e* of FIG. 25. The process can then be reversed for reconnection, following steps 25*e* through 25*a*.

Figure 22:
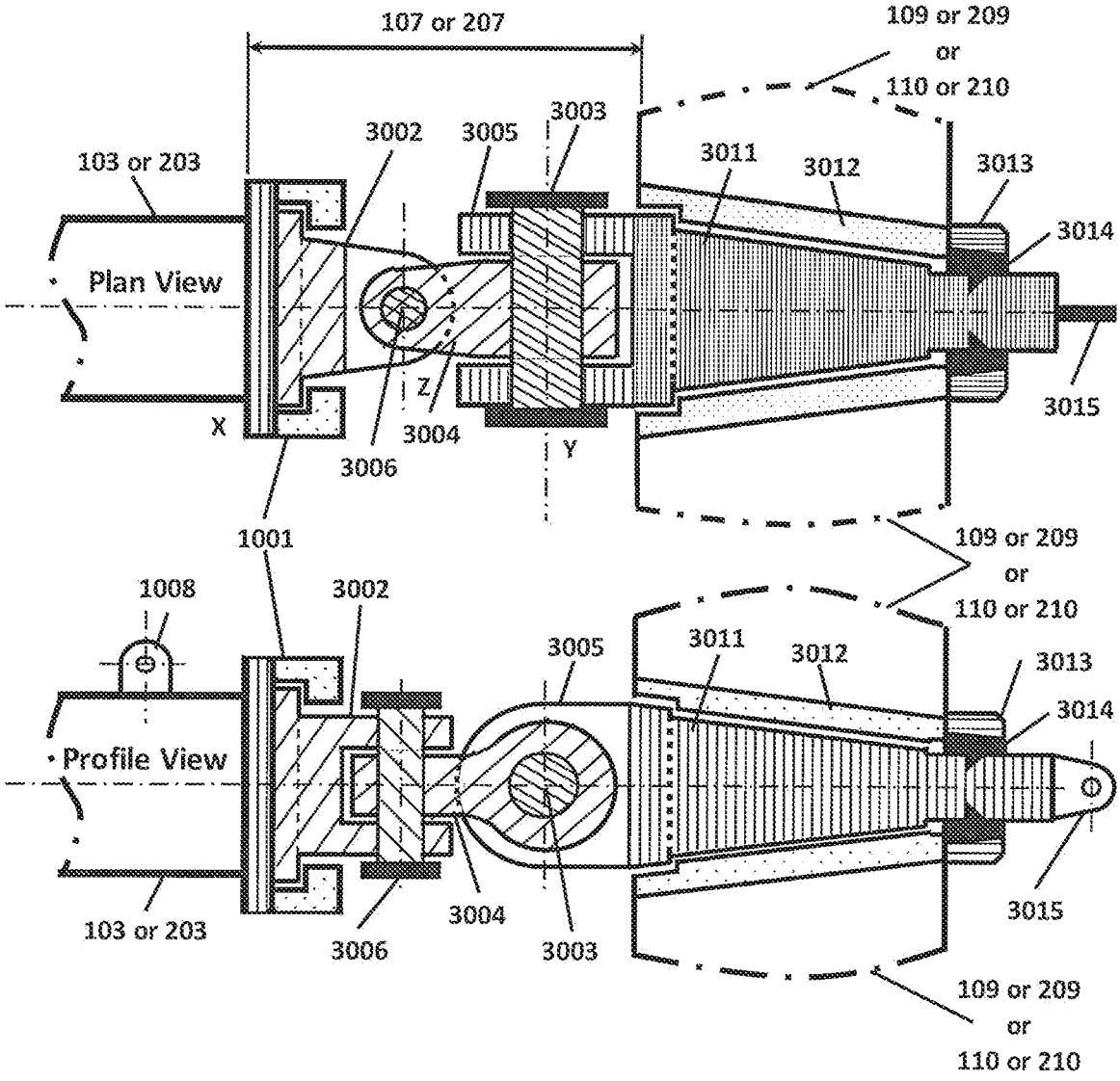
FIG. 22 shows the x, y and z-axis bearing assembly of one aspect of the disclosure, with a collet connector to be attached to the ballast weight or fulcrum.

A collet connector (3011), with clevis (3005) of FIGS. 22 and 26 may be used for making the connection to the ballast weight (109) using pull-in winch 823 and leaving the pull-in rope tethered on buoys (632 and 633), as shown in steps 26*a* through 26*e* of FIG. 26. Reconnection is made following steps 26*e* through 26*a*.

Figure 23:
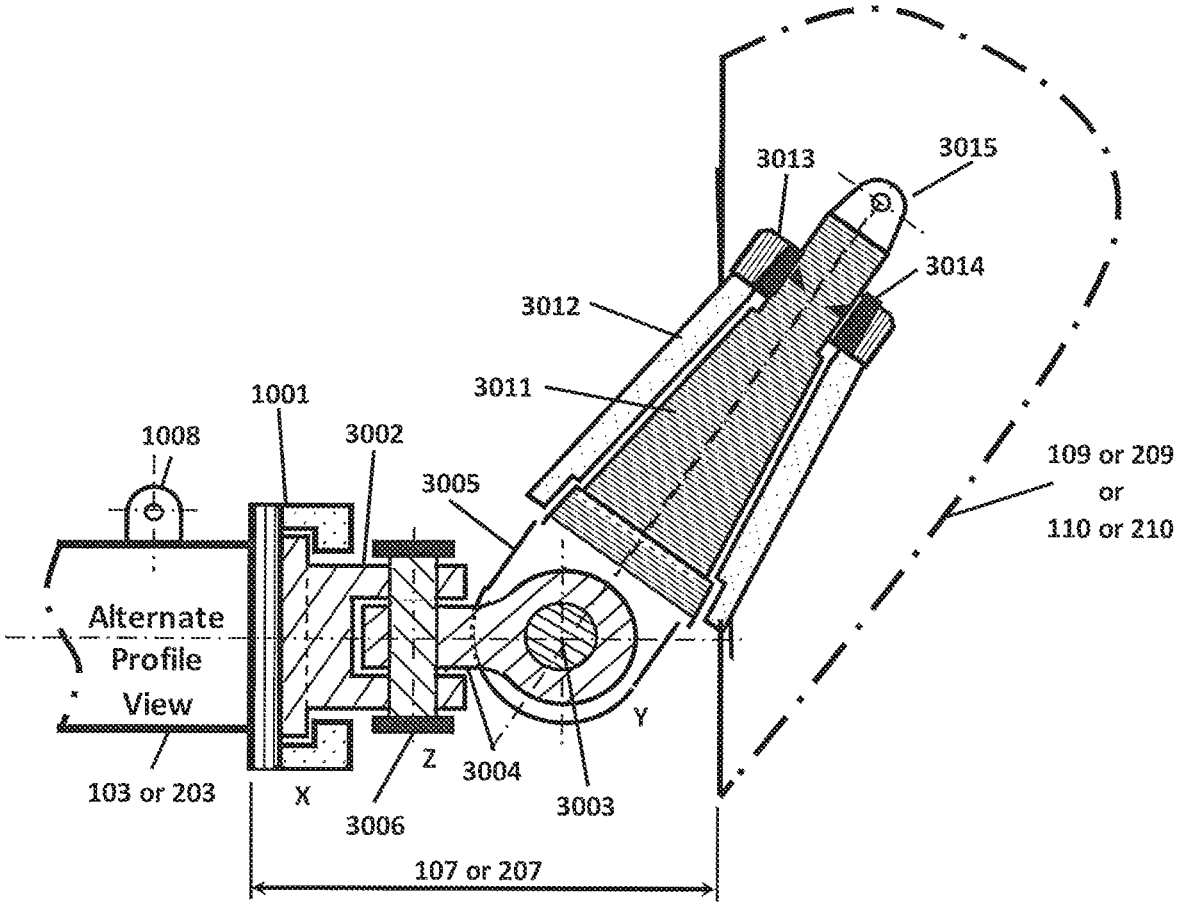
Figure 24:
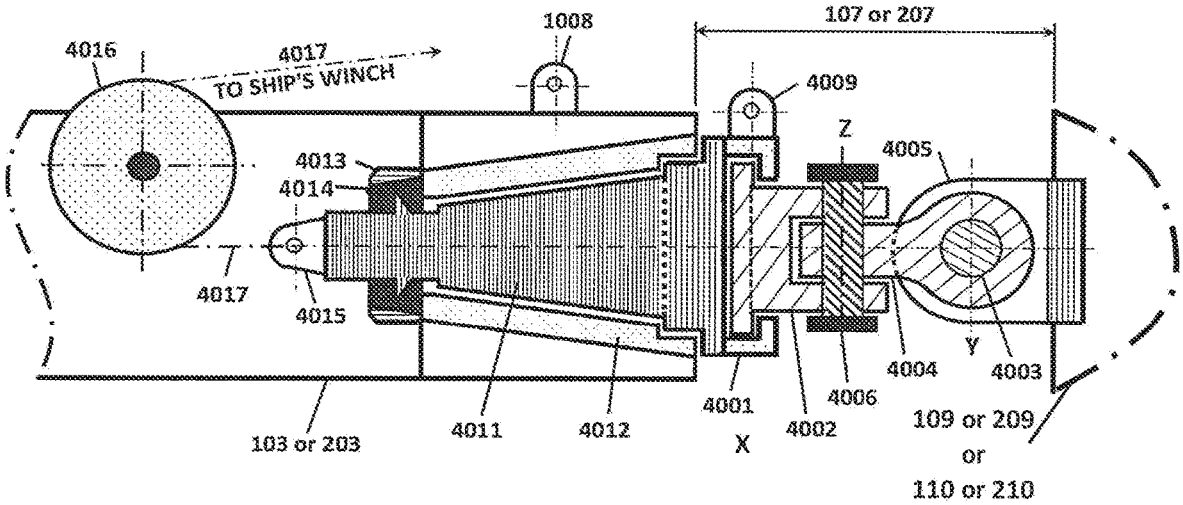
FIG. 24 shows the x, y and z-axis bearing assembly of one aspect of the disclosure, with a collet connector to be attached to the yoke, to minimize weight handled during disconnection and reconnection.

If the collet connector (3011) with clevis (3005) is angled upward, its pull-in operation for connection to the ballast weights (109) or rigid pendular tension member fulcra may be facilitated as shown in FIGS. 23 and 27 or 28.

To minimize the weight on the yoke (103,203), the collet connectors (4011) with clevis (4005) may be left with the ballast weights (109,209), as shown in FIG. 29. This further enhances the ease with which the yoke may be lifted or deballasted for reconnection. FIG. 30 shows a pull-in arrangement and method for storing the ballast weight after disconnection. This embodiment shows pull-in effected using snatch blocks (4020,4021) and one of the handling winches (1021) with rope (4018).

The soft yoke mooring system must be designed to withstand and counteract loads from environmental forces (wind, waves and current) associated with what is termed the 100 year event. Depending on location, it is typical that the normal day to day environmental forces and hence, required restoring forces and moments are two orders of magnitude lower than those experienced during the 100 year event. At each one of the hinge points (8) and swivel points (7) normal benign environmental forces still cause the floating structure (4) and link-arms to move and rotate. Because the system must be designed for 100 year events, the weight (9) is very great, on the order of 550 mt per pendant. Hence as the floating structure (4) experiences small perturbations during most of its life, these hinge points are subjected to a load due to the deadweight of (9) which is on the same order of magnitude as the load experienced on the system during the 100 year event. The result of this is wear of the bearings at each hinge point and swivel, reversing fatigue inducing moments and slip-stick noise emanating from the bearings and big heavy, and costly components to withstand the high deadweight, in combination with mooring loads.

The soft yoke mooring system depends on a ballast weight (9) rigidly connected to its yoke (3). This, in one embodiment, provides x and y-axis hinges (8) at the top of their pendular tension members (10) and x and y-axis hinges and z-axis swivels (8) at the bottom of their pendular tension members (10). Hence bearings are subjected to the full mooring load plus deadweight load of the ballast weight (9).

The soft yoke mooring system has no mechanical advantage in its use of its ballast weight (9) to generate more mooring restoring force.

The disconnectable soft yoke mooring system may disconnect at the yoke head connection, leaving the cumbersome assembly of yoke (3), ballast weight (9) and pendular tension members (10) hanging from the mooring support structure (11) or if a submerged disconnectable soft yoke mooring system, at a connection point between the pendular tension members (10) and the mooring support structure (11), leaving an extremely heavy and immobile assembly on the sea floor (12).

The solutions to the problem, provided herein are to a) remove as many of the hinge and swivel assemblies (7) from the load path of that pendular weight (9) as possible, b) reduce the weight of the pendular weight (9) as much as possible and c) disconnect at a convenient point between the yoke (3) and ballast weight (9).

Aspects of the disclosure provide those three solutions and solves this problem in three ways:

a. First, by moving the hinge and swivel assemblies (7) from the tensile pendants (10) to the yoke structure (3), those mechanisms are completely removed from the weight (9) load path. Being part of the yoke structure means they now transmit primarily the restoring forces required by the system, which as mentioned before are, under normal operating sea conditions, two orders of magnitude lower than the design requirements of the 100 year event. A similar reduction in pin diameter and assembly weight results in a reduction in the tendency toward slip-stick by two orders of magnitude and a significant reduction in wear and component cost. The yoke ends carry the dead weight of the relatively light yoke structure b. Secondly, by replacing the tensile pendant members (10) with members resistant to bending, the new rigid pendular tension member fulcra (210) can provide similar restoring force and moment curves vs. displacement as in the conventional soft yoke mooring system, using less weight (9) per pendant, by using mechanical advantage afforded by the rigid pendular tension member fulcra (210). The restoring force may actually be lower for floating structure (204) perturbations. For small perturbations, this results in a higher excursion from the greater angle theta of FIG. 12, which results in more damping energy absorbed by the hull-sea interface and less by the mooring system. If the hinges and swivel assemblies (207) are moved to a point half way between the hinge assemblies (208) and the weights (209), the load on the hinges (208) of the soft yoke mooring arrangement can be roughly half that of the conventional soft yoke mooring system. Hence, they may be designed with smaller pins at the top (208), which not only reduces weight and cost, but also reduces the frictional end moments such that, given the greater stiffness of the rigid pendular tension members compared to the pendular tensile members, reduces the tendency toward slip-stick behavior by roughly an order of magnitude. Although the angular perturbations of the fulcra (210) are roughly twice that of the tensile pendants (10), because the pins are smaller in diameter and the applied load is half that of the tensile pendants for the majority of the operating time, the wear at the bearings is lower in the soft yoke mooring arrangement as well.

c. By disconnecting at the interface between the yoke (3) and ballast weight (9), the yoke (3) which requires handling for reconnection is $1/10^{th}$ the weight of the ballast weight (9) and hence may more easily be handled, rotated, lifted and/or deballasted to facilitate reconnection with lighter lifting gear and fewer tugs for floating structure (4) position and heading keeping.

In one example embodiment, an arrangement is described. The embodiment may comprise at least one mooring support structure configured to be attached to a floating structure and at least one first connection connected to the mooring support structure. The arrangement may also comprise a first ballast weight connected to the at least one first connection, a second ballast weight connected to the at least one first connection and at least one second connection connected to the first ballast weight and the second ballast weight. The arrangement may also comprise at least one yoke connected to the at least one second connection, at least one third connection connected to the yoke; and at least one fourth connection connected to the at least one third bearing.

In one example embodiment, the arrangement may be configured wherein the at least one mooring support structure is two mooring support structures.

In one example embodiment, the arrangement may further comprise pendular tension members located between the mooring support structure and the first and second ballast weight, wherein the tension members are configured to withstand both tension and bending.

In one example embodiment, the arrangement may be configured wherein the first, second, third and fourth connections are part of a load path between one of the yoke and first and second ballast weights and the pendular tension members.

In one example embodiment, the arrangement may be configured wherein the arrangement is configured to be disconnected and reconnected from the floating structure.

In one example embodiment, the arrangement may be configured wherein the disconnection and reconnection occur between the yoke and pendular tension members.

In one example embodiment, the arrangement may be configured wherein the disconnection and reconnection occur at the at least one second connection.

In one example embodiment, the arrangement may be configured wherein the at least one second connection allows rotation around three axes.

In one example embodiment, the arrangement may be configured wherein the at least one first connection allows rotation around two axes.

In one example embodiment, the arrangement may be configured wherein the at least one third connection allows rotation around two axes.

In one example embodiment, the arrangement may be configured wherein the at least one fourth connection allows rotation around one axis.

In one example embodiment, the arrangement may be configured wherein the first and second ballast weight are a single weight.

In one example embodiment, the arrangement may be configured wherein the single weight is located below a surface level of water.

In one example embodiment, the arrangement may be configured wherein the first and the second ballast weight are located below a surface level of water.

In one example embodiment, the arrangement may further comprise at least one pin, located between the floating structure and the mooring support structure, the at least one pin configured to connect and disconnect the floating structure to the mooring structure.

In one example embodiment, an arrangement is disclosed. The arrangement may comprise at least one mooring support structure configured to be attached to a floating structure. The arrangement may also comprise a first connection connected to the mooring support structure. The arrangement may also comprise at least one ballast weight connected to the at least one first bearing and at least one link arm. The arrangement may also comprise at least one yoke and at least one additional connection connected to the at least one ballast weight and at least one of the at least one link arm and at least one yoke, the at least one additional connection providing one degree of freedom.

REFERENCE NUMBERS USED IN THE FIGS

The following table shows the numbering system used to call out the elements in the FIGS. Where the number has a prime, such as X' it signifies the component corresponding to X on the side to the negative y direction:

1 Earth fixation point
2 Earth fixed structure
3 Rigid yoke
4 Floating structure
5 Main z-axis bearing between earth fixed and rotating structures
6 Bearings providing rotation about the x and y-axes at the yoke head
7 Bearings providing rotation about the x, y and z-axes at the lower link-arm
8 Bearings providing rotation about the x and y-axes at the upper link-arm
9 Ballast weight for generating restoring force
10 Link-arm
11 Mooring support structure
12 Sea floor
13 Surface of the water
15 Additional ballast weight shown in some prior art

16 Alternate location for y-axis bearing in some prior art, normally installed at component (7)
17 Yoke connector for disconnectable mooring system
17*a* Main connecting pin between mooring tether and mooring cradle
17*b* Mooring cradle
19 Mooring buoy
21 Mooring leg fixation point to sea floor
22 Mooring leg
23 Link-arm
24 Floating structure
25 z-axis bearing at buoy
26 x-axis bearing in link arm
27 y-axis bearing between pendulum and floating structure
29 y-axis bearing between link-arm and pendulum
29 Ballast weight for generating restoring force
30 Pendulum
31 Mooring support structure
32 Sea floor
33 Surface of the water
41 Earth fixation point
42 Earth fixed structure
43 Link-arm
44 Floating structure
45 Main z-axis bearing between earth fixed and rotating structures
46 y-axis bearing between rotating structure and link-arm
47 y-axis bearing between yoke and pendulum
48 x and y-axes bearings between link-arm and pendulum
49 Ballast weight for generating restoring force
50 Pendulum
51 yoke
52 Sea floor
53 Surface of the water
54 y-axis bearings between yoke and floating structure
55 Buoy
56 z-axis bearing at buoy
60 y-axis bearing shown in some prior art
71 Earth fixation point
72 Earth tethered structure
73 Yoke
74 Floating structure
75 x, y and z-axes bearings between earth fixed structure and link-arm
76 x and y-axes between earth fixation point and earth tethered structure
78 y-axis bearings between yoke and floating structure
82 Sea floor
83 Surface of the water
101 Earth fixation point
102 Earth fixed structure
103 Yoke
104 Floating structure
105 Main z-axis bearing between earth fixed and rotating structures
106 Bearings providing rotation about the x and y-axes at the yoke head
107 Bearings providing rotation about the x, y and z-axes between the yoke and ballast weight
108 Bearings providing rotation about the x and y-axes at the upper link-arm
109 Ballast weight for generating restoring force
110 Pendular tension member
111 Mooring support structure
112 Sea floor
113 Surface of the water
117 Connector between yoke and ballast weight bearings
201 Earth fixation point
202 Earth fixed structure
203 Yoke
204 Floating structure
205 Main z-axis bearing between earth fixed and rotating structures
206 Bearings providing rotation about the x and y-axes at the yoke head
207 Bearings providing rotation about the x, y and z-axes between the yoke and rigid pendular tension member fulcrum
208 Bearings providing rotation about the x and y-axes at the upper rigid pendular tension member fulcrum
209 Ballast weight for generating restoring force
210 Rigid pendular tension member fulcrum
211 Mooring support structure
212 Sea floor
213 Surface of the water
217 Connector between yoke and rigid pendular tension member fulcrum bearings
621 Yoke handling winch and rope
622 Removable z-axis pin handling winch and rope
623 Bearing assembly handling winch and rope
630 Buoy on yoke side of yoke handling rope
631 Buoy on winch side of yoke handling rope
632 Buoy on collet connector side of collet connector pull-in rope
633 Buoy on winch side of collet connector pull-in rope
723 Collet connector pull-in winch and rope
816 Collet connector pull-in sheave
823 Collet connector pull-in winch and rope
923 Collet connector pull-in winch and rope
1001 x-axis bearing housing
1002 Yoke clevis
1003 y-axis pin between yoke clevis and mooring connector
1004 Mooring connector
1005 Ballast weight or rigid pendular tension clevis
1006 Removable z-axis pin between connector and ballast weight or rigid pendular tension member fulcrum
1007 Index stop
1007*a* Index stop retracted
1007*b* Index stop in operating position
1008 Padeye for handling yoke during disconnection and reconnection
1010 Padeye for handling removable z-axis pin
1023 Collet connector pull-in winch
1021 Yoke handling winch
2002 Yoke clevis
2003 y-axis pin between mooring connector and ballast weight or rigid pendular tension member fulcrum
2004 Mooring connector
2005 Clevis of ballast weight or rigid pendular tension member fulcrum
2006 Removable z-axis pin between connector and ballast weight or rigid pendular tension member fulcrum
2007 Index stop
2007*a* Index stop retracted
2007*b* Index stop in operating position
2009 Padeye or handling bearing assembly during disconnection and reconnection
2010 Padeye for handling removable z-axis pin
3002 Yoke clevis
3003 y-axis pin between mooring connector and collet connector
3004 Mooring connector

3005 Collet connector clevis
3006 z-axis pin between yoke clevis and mooring connector
3011 Collect connector hub
3012 Collet connector socket
3013 Collet connector press ring
3014 Collet connector finger
3015 Collet connector pull-in padeye
4001 x-axis bearing housing
4002 Collet clevis
4003 y-axis pin between mooring connector and ballast weight or rigid pendular tension member fulcrum
4004 Mooring connector
4005 Ballast weight or rigid pendular tension member fulcrum
4006 z-axis pin between collet clevis and mooring connector
4009 Padeye for handling bearing and collet hub assembly during disconnection and reconnection
4011 Collet connector hub
4012 Collet connector socket
4013 Collet connector press ring
4014 Collet connector finger
4015 Collet connector pull-in padeye
4016 Collet connector pull-in sheave
4017 Collet connector pull-in rope
4018 Yoke handling rope
4019 Air hose for deballasting yoke
4020 Lower snatch block for ballast tank pull-in
4021 Upper snatch block for ballast tank pull-in The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may be varied in many ways. Such variations are not to be regarded as a departure from the disclosure, and all such modifications are intended to be included within the scope of the disclosure.

While embodiments have been described herein, those skilled in the art, having benefit of this disclosure, will appreciate that other embodiments are envisioned that do not depart from the inventive scope. Accordingly, the scope of the present claims or any subsequent claims shall not be unduly limited by the description of the embodiments described herein.

What is claimed is:

1. An arrangement, comprising:

at least one mooring support structure configured to be attached to a floating structure;

at least one first connection connected to the mooring support structure;

a first ballast weight connected to the at least one first bearing;

a second ballast weight connected to the at least one first bearing;

at least one second connection connected to the first ballast weight and the second ballast weight;

at least one yoke connected to the at least one second connection;

at least one third connection connected to the yoke; and at least one fourth connection connected to the at least one third connection.

2. The arrangement according to claim 1, wherein the at least one mooring support structure is two mooring support structures.

3. The arrangement according to claim 1, further comprising:

pendular tension members located between the mooring support structure and the first and second ballast weight, wherein the tension members are configured to withstand both tension and bending.

4. The arrangement according to claim 3, wherein the first, second, third and fourth connections are part of a load path between one of the yoke and first and second ballast weights and the pendular tension members.

5. The arrangement according to claim 1, wherein the arrangement is configured to be disconnected and reconnected from the floating structure.

6. The arrangement according to claim 5, wherein the disconnection and reconnection occur between the yoke and pendular tension members.

7. The arrangement according to claim 6, wherein the disconnection and reconnection occur at the at least one second connection.

8. The arrangement according to claim 1, wherein the at least one second connection allows rotation around three axes.

9. The arrangement according to claim 1, wherein the at least one first connection allows rotation around two axes.

10. The arrangement according to claim 1, wherein the at least one third connection allows rotation around two axes.

11. The arrangement according to claim 1, wherein the at least one fourth connection allows rotation around one axis.

12. The arrangement according to claim 1, wherein the first and the second ballast weight are located below a surface level of water.

13. The arrangement according to claim 1, further comprising:

at least one pin, located between the floating structure and the mooring support structure, the at least one pin configured to connect and disconnect the floating structure to the mooring structure.

* * * * *